US012709898B2

(12) United States Patent
Ealer, Sr. et al.

(10) Patent No.: US 12,709,898 B2
(45) Date of Patent: Aug. 18, 2026

(54) GUTTER HANGER AND COVERING SYSTEM

(71) Applicant: E-Z Products LLC, St. Clair, MO (US)

(72) Inventors: James E. Ealer, Sr., St. Clair, MO (US); James E. Ealer, Jr., St. Clair, MO (US)

(73) Assignee: E-Z PRODUCTS LLC, St. Clair, MO (US)

( * ) Notice: Subject to any disclaimer, the term of this patent is extended or adjusted under 35 U.S.C. 154(b) by 0 days.

(21) Appl. No.: 19/301,574

(22) Filed: Aug. 15, 2025

(65) Prior Publication Data

US 2026/0132632 A1 May 14, 2026

Related U.S. Application Data

(60) Provisional application No. 63/746,553, filed on Jan. 17, 2025, provisional application No. 63/720,246, filed on Nov. 14, 2024.

(51) Int. Cl.
*E04D 13/076* (2006.01)
*E04D 13/072* (2006.01)

(52) U.S. Cl.
CPC ..... *E04D 13/076* (2013.01); *E04D 13/0727* (2013.01)

(58) Field of Classification Search
CPC . E04D 13/076; E04D 13/0725; E04D 13/068; E04D 13/0685
USPC ..... 52/12, 11
See application file for complete search history.

(56) References Cited

U.S. PATENT DOCUMENTS

| | | | | |
|---|---|---|---|---|
| 891,405 | A | 6/1908 | Cassens et al. | |
| 2,209,741 | A | 7/1940 | Sullivan et al. | |
| 3,436,878 | A | 4/1969 | Singer | |
| 4,241,548 | A | 12/1980 | Rowe | |
| 4,294,422 | A | 10/1981 | Odekirk | |
| 4,727,689 | A | 3/1988 | Bosler | |
| 5,557,891 | A * | 9/1996 | Albracht | E04D 13/076 52/12 |
| 5,737,879 | A | 4/1998 | Sweet | |

(Continued)

FOREIGN PATENT DOCUMENTS

| | | | |
|---|---|---|---|
| CA | 2405756 | C | 3/2004 |
| CA | 2593808 | C | 1/2009 |

(Continued)

*Primary Examiner* — Kyle J. Walraed-Sullivan
(74) *Attorney, Agent, or Firm* — Stinson LLP

(57) ABSTRACT

A gutter hanger and covering system used to simultaneously hang and cover a gutter includes a dual-purpose gutter guard. The dual-purpose guard connects to the gutter by engaging a gutter lip and a rear gutter wall. The guard covers an open top of the gutter and defines openings for water passage and debris filtration. The guard can include a screw section for pre-installing screws used during installation. The guard includes a channel for retaining a portion of the overlay panel therein to mount the overlay panel on the guard. The system can comprise a non-hanger covering panel of a different profile than the dual-purpose gutter guard for use in forming mitered corners or as a removable access panel. The system can also comprise an overlay panel configured to prevent finer debris from entering the gutter.

16 Claims, 22 Drawing Sheets

(56) References Cited

U.S. PATENT DOCUMENTS 6,134,843 A * 10/2000 Tregear ..... E04D 13/076 52/12
6,282,845 B1 * 9/2001 Hines ..... E04D 13/076 52/12
6,427,388 B1 8/2002 Brochu
6,786,008 B2 * 9/2004 Brochu ..... E04D 13/076 52/12
6,826,872 B2 12/2004 Brochu
D523,538 S 6/2006 Brochu
7,143,549 B2 12/2006 Brochu
7,614,185 B2 * 11/2009 Brochu ..... E04D 13/076 52/12
7,891,142 B1 2/2011 Ealer, Sr.
7,913,458 B2 3/2011 Higginbotham
8,191,315 B1 6/2012 Brochu
8,250,813 B2 * 8/2012 Robins ..... E04D 13/076 52/12
8,316,585 B2 * 11/2012 Brochu ..... E04D 3/364 52/12
8,322,082 B2 * 12/2012 Neumann ..... E04D 13/076 52/12
8,347,557 B2 1/2013 Minor, Sr. et al.
8,375,644 B2 2/2013 Robins
8,397,436 B2 3/2013 Higginbotham
8,402,697 B1 * 3/2013 Ealer, Sr. ..... E04D 13/076 52/12
8,474,192 B2 7/2013 Horton
8,495,835 B2 7/2013 Timmons
8,528,262 B2 9/2013 Horton et al.
8,635,811 B2 1/2014 Horton
8,695,282 B2 4/2014 Glander
9,127,463 B1 9/2015 Feldhaus
9,422,722 B2 8/2016 Iannelli
9,915,070 B2 3/2018 Lenney
10,344,482 B2 7/2019 Brochu
10,465,388 B2 11/2019 Brochu et al.
10,538,921 B2 1/2020 Brochu
10,604,936 B2 3/2020 Brochu
10,689,855 B2 6/2020 Brochu
11,060,293 B2 * 7/2021 Graves ..... E04D 13/076
11,377,853 B2 7/2022 Wood
11,661,747 B2 5/2023 Brochu
11,718,996 B2 * 8/2023 Graves ..... E04D 13/076 52/12
2002/0166290 A1 11/2002 Bergeron
2003/0061770 A1 4/2003 Lynch
2005/0204642 A1 * 9/2005 Valentini ..... E04D 13/076 52/12
2006/0156636 A1 7/2006 Walker
2007/0012845 A1 1/2007 Iannelli
2007/0169423 A1 * 7/2007 Brochu ..... E04D 13/076 52/12
2008/0010906 A1 1/2008 Brochu
2008/0029654 A1 2/2008 Iannelli
2008/0134587 A1 6/2008 Ealer
2008/0289263 A1 11/2008 Brochu
2009/0056234 A1 3/2009 Brochu
2011/0099916 A1 * 5/2011 Minor, Sr. ..... E04D 13/0725 52/60
2011/0138697 A1 6/2011 Martin
2011/0265390 A1 11/2011 Brochu
2012/0186163 A1 7/2012 Walker
2012/0192502 A1 * 8/2012 Glander ..... E04D 13/076 52/12
2013/0248672 A1 9/2013 Martin
2013/0284867 A1 10/2013 Walters
2014/0069027 A1 3/2014 Reese
2016/0102459 A1 4/2016 Breyer
2016/0201329 A1 * 7/2016 Ianelli ..... E04D 13/072 52/12
2017/0058531 A1 3/2017 Brochu
2017/0204611 A1 * 7/2017 Brochu ..... E04D 13/076
2018/0127981 A1 * 5/2018 Brochu ..... E04D 13/076
2019/0136536 A1 * 5/2019 Brochu ..... E04D 13/076
2020/0217074 A1 7/2020 Graves
2020/0270868 A1 8/2020 Gramling
2021/0062512 A1 * 3/2021 Brochu ..... E04D 13/076
2022/0136250 A1 * 5/2022 Brochu ..... E04D 13/068 52/12
2023/0027949 A1 1/2023 Brochu
2024/0093500 A1 3/2024 Gori et al.
2024/0093501 A1 3/2024 Crowell et al.
2024/0392573 A1 11/2024 Kelly

FOREIGN PATENT DOCUMENTS

CA 2993239 A1 4/2018
JP 02058664 A 2/1990
WO WO-9530809 A1 * 11/1995 ..... E04D 13/064

* cited by examiner

GUTTER HANGER AND COVERING SYSTEM

CROSS-REFERENCE TO RELATED APPLICATIONS

This application claims priority to U.S. Provisional Application No. 63/746,553, filed Jan. 17, 2025, and to U.S. Provisional Patent Application No. 63/720,246, filed Nov. 14, 2024, the contents of each which is incorporated herein by reference in its entirety.

FIELD

The present disclosure relates to a gutter hanger and covering system for hanging and covering a gutter.

BACKGROUND

Gutter systems play a role in protecting structures from water damage and leakages. Gutter systems generally include gutter components such as gutters, downspouts, outlets, elbows, guards, etc. to facilitate directing water flow from a roof of a structure to an appropriate area away from the structure. Gutter systems further include separate securing components such as straps and gutter hangers.

Due to the multitude of components involved in gutter systems, the processes for installing gutter systems require considerable time and effort. For example, to mount a gutter to a fascia board, individual hangers are fitted in the gutter about every 18-36 inches and then fastened to the fascia board.

To prevent debris from entering the gutter and interfering with water flow throughout the gutter, a separate gutter guard may be installed. The gutter guard installation process involves applying the gutter guard (e.g., a screen) to an open top of the gutter and securing the screen with additional fasteners to the gutter and fascia board.

SUMMARY

According to an aspect of the present disclosure, a gutter hanger and covering system is provided for hanging a gutter from a fascia board and covering an open top of the gutter, wherein the gutter has a front gutter wall including a gutter lip, a bottom gutter wall and a rear gutter wall. The gutter hanger and covering system comprises a dual-purpose gutter guard comprising a front connection structure, a central portion and a rear connection structure. The front connection structure is configured to connect to the gutter lip. The rear connection structure is configured to connect to the rear gutter wall. The central portion is sized and shaped to cover the open top of the gutter. The rear connection structure comprises a rear overlay receiving channel. The central portion defines first openings for water passage and debris filtration. The gutter hanger and covering system further comprises an overlay panel comprising a front end portion, a rear end portion, and a central portion extending from the front end portion to the rear end portion. The overlay panel is configured to mount on the dual-purpose gutter guard such that the overlay panel covers the first openings. The rear end portion of the overlay panel is configured to fit into the rear overlay receiving channel to secure the rear end portion of the overlay panel to the dual-purpose gutter guard. At least the central portion of the overlay panel defines second openings for water passage and debris filtration. The second openings are smaller than the first openings.

According to other aspects of the present disclosure, the gutter covering system may include one or more of the following features. The dual-purpose gutter guard may comprise sheet metal defining the first openings and the overlay panel may comprise woven wire mesh defining the second openings. The front connection structure may comprise a rearward projecting finger and a downturned edge margin. The front connection structure may be configured to connect to the gutter lip such that the downturned edge margin is pressed rearward by the front gutter wall whereby the rearward projecting finger is urged into engagement with a hem of the gutter lip. The overlay panel may be substantially flat and the dual-purpose gutter guard may be undulating. The overlay panel may comprise a sheet of woven wire mesh forming the central portion, a front sheet metal flange crimped onto the sheet of woven wire mesh and forming the front end portion, and a rear sheet metal flange crimped onto the sheet of woven wire mesh and forming the rear end portion. The gutter covering system may further comprise a plurality of screws configured to screw the front end portion of the overlay panel onto the central portion of the dual-purpose gutter guard. The central portion of the dual-purpose gutter guard may comprise a primary covering section for covering most of the open top of the gutter. The front end portion of the overlay panel may be configured to rest on the primary covering section when the rear end portion is fitted into the overlay receiving channel. The central portion of the dual-purpose gutter guard may further comprise an angled debris lifter between the primary covering section and the front connection structure. The primary covering section may extend from the overlay receiving channel to the angled debris lifter. The primary covering section may be substantially planar but may include a plurality of discrete undulations.

According to another aspect of the present disclosure, a dual-purpose gutter guard is provided for covering a gutter and hanging the gutter from a fascia board, wherein the gutter has a gutter lip, a front gutter wall, a bottom gutter wall, and a rear gutter wall. The gutter hanger comprises front connection structure configured to couple to the gutter lip, a central portion configured to cover an open top of the gutter, and rear connection structure configured to connect to a top edge margin of the rear gutter wall. The rear connection structure comprises a screw section. The screw section is positioned so as to be spaced apart in front of the top edge margin of the rear gutter wall when the rear connection structure is connected to the top edge margin of the rear gutter wall. The screw section is configured so that a plurality of screws can be preinstalled in the rear connection structure to first positions to form a reinforced gutter unit.

According to other aspects of the present disclosure, the dual-purpose gutter guard may include one or more of the following features. The dual-purpose gutter guard may be configured to hang the gutter from the fascia board by advancing the screws into the fascia board from the first positions to fully screwed-in positions without removing the screws from the reinforced gutter unit. The rear connection structure may comprise a front portion, a rear portion, and an upper crease connecting the front portion to the rear portion. The rear connection structure may be configured to receive the top edge margin of the rear gutter wall between the front portion and the rear portion. The screw section may be formed on the front portion of the rear connection structure. The front portion of the rear connection structure may further comprise a forward facing channel beneath the screw section. The forward facing channel may have a back side and the back side may be configured to contact the top edge margin of the rear gutter wall when the rear connection structure is clipped onto the top edge margin. The forward facing channel may include an upper segment connected to the screw section at an upturned bend. The screw section may extend at an upward and rearward angle from the upturned bend. The upturned bend may be forwardly spaced from the back side of the forward facing channel, and the back side may be configured to contact the top edge margin of the rear gutter wall. The screw section may extend upward from the upturned bend to a backward joggle. The front portion of the rear connection structure may further comprise an upper flange extending upward from the backward joggle to the upper crease. The upper flange and the back side of the forward facing channel may be configured to contact the top edge margin of the rear gutter wall on opposite sides of a bead formed therein. The screw section may be configured to be spaced apart in front of the bead. A rear segment of the central portion may underlie the upper segment of the forward facing channel and the forward facing channel may be configured to retain a rear portion of an overlay panel for covering the central portion of the dual-purpose gutter guard. The screw section may be configured so that, in the first positions, tip portions of the screws engage the top edge margin of the rear gutter wall as set screws whereby the plurality of screws fasten the dual-purpose gutter guard to the gutter to form a reinforced gutter unit in which the gutter is reinforced by the dual-purpose gutter guard to resist sagging so that the dual-purpose gutter guard is movable as a unit into position for installation on the fascia board.

According to another aspect of the present disclosure, a method of hanging a gutter on a fascia board is provided. The method comprises installing a plurality of dual-purpose gutter guards in series along the gutter by engaging a front connection structure of each dual-purpose gutter guard with a gutter lip and clipping a rear connection structure of each dual-purpose gutter guard onto a top edge margin of a rear gutter wall. The method further comprises securing each of the dual-purpose gutter guards in series to form a reinforced gutter unit by installing a plurality of screws into a screw section of the rear connection structure of each of the dual-purpose gutter guards so that tip portions of the screws engage the top edge margin of the rear gutter wall as set screws and thereby fasten the dual-purpose gutter guards to the gutter. The method further comprises lifting the reinforced gutter unit into a guttering position on a fascia board and hanging the gutter from the gutter unit by advancing said screws in the screw section of the rear connection structure of the dual-purpose gutter guards into the fascia board.

According to other aspects of the present disclosure, the method may include one or more of the following features. The steps of installing and securing may be performed while the gutter rests on a surface spaced apart below the fascia board. The plurality of dual-purpose gutter guards may be arranged in series to cover at least a contiguous 20-ft length of the gutter. The method may further comprise installing an overlay panel on at least one of the dual-purpose gutter guards. All of the screws used to hang the gutter from the fascia board may be preinstalled during said securing.

According to another aspect of the present disclosure, a dual-purpose gutter guard is provided for covering a gutter and hanging the gutter from a fascia board, wherein the gutter has a gutter lip, a front gutter wall, a bottom gutter wall, and a rear gutter wall. The dual-purpose gutter guard comprises a front connection structure configured to couple to the gutter lip, a central portion configured to cover an open top of the gutter, and a rear connection structure. The rear connection structure comprises a front portion, a rear portion, and an upper crease connecting the front portion to the rear portion. The rear connection structure is configured to receive the top edge margin of the rear gutter wall between the front portion and the rear portion. The rear connection structure further comprises an upturned bend, a screw section extending upward from the upturned bend, a backward joggle, and an upper flange extending upward from the backward joggle. The screw section is configured to be positioned in front of the top edge margin of the rear gutter wall when the top edge margin of the rear gutter wall is between the front portion and the rear portion such that a plurality of screws can be advanced through the screw section into engagement with the top edge margin of the rear gutter wall.

According to another aspect of the present disclosure, a dual-purpose gutter guard is provided for covering a gutter and hanging the gutter from a fascia board, wherein the gutter has a gutter lip, a front gutter wall, a bottom gutter wall, and a rear gutter wall. The dual-purpose gutter guard comprises a rear connection structure configured to couple to the rear gutter wall, a front connection structure configured to engage an underside of the gutter lip to couple the dual-purpose gutter guard to the gutter lip, and a central portion configured to cover an open top of the gutter. The central portion comprises a primary covering section for covering most of the open top of the gutter and an angled debris lifter extending forward and upward from the primary covering section toward the front connection structure.

According to other aspects of the present disclosure, the dual-purpose gutter guard may include one or more of the following features. The front connection structure may comprise a rearward projecting finger configured to engage a hem of the gutter lip. The angled debris lifter may comprise an apex and the rearward projecting finger may comprise a tip spaced apart from the apex by a gap. The gap may have a dimension extending from the tip to the apex, and the dimension may be less than ⅜". The dual-purpose gutter guard may be configured to be installed on the gutter by orienting the dual-purpose gutter guard in an upright orientation with respect to the gutter and rotating the dual-purpose gutter guard downward to an installed position whereby the rearward projecting finger engages the hem of the gutter lip and the rear connection structure clips onto the top edge margin of the rear gutter wall. As the dual-purpose gutter guard rotates downward to the installed position, a downturned edge margin of the front connection structure may be configured to cam against a curved surface of the front gutter wall of the gutter to press the rearward projecting finger upward into the hem of the gutter lip. The dual-purpose gutter guard may further comprise a bend between the primary covering section and the angled debris lifter. The angled debris lifter may have an angled debris lifter height from the bend to the apex and the angled debris lifter height may be greater than ¼". The tip of the rearward projecting finger may be vertically spaced apart from the bend by a finger height and the finger height and the angled debris lifter height may differ by less than ⅜". The primary covering section may include a front covering segment adjacent the bend and an included angle between the angled debris lifter and the front covering segment above the dual-purpose gutter guard may be in an inclusive range from 120° to 160°. The front connection structure may comprise a decline segment extending forward and downward from the apex to a lower bend, an incline segment extending forward and upward from the lower bend to a rearward bend, a lower finger segment extending rearward from the rearward bend to a finger crease, and an upper finger segment extending forward from the finger crease. The apex may define an included angle below the dual-purpose gutter guard in an inclusive range from 80° to 150°. The lower bend may define an included angle above the dual-purpose gutter guard in an inclusive range from 80° to 150°. The rearward bend may define an included angle rearward of the incline segment and below the lower finger segment in an inclusive range from 20° to 60°. The lower finger segment may have a front to back dimension extending from the rearward bend to the finger crease in an inclusive range from ¼" to ¾". The front connection structure may further comprise a downturned edge margin and a downturned bend between the downturned edge margin and the upper finger segment. The dual-purpose gutter guard may have a length and the dual-purpose gutter guard may be configured to hang the same length of gutter from a fascia board without any other gutter hanger or reinforcement. The front connection structure may be configured to couple to the gutter lip for hanging the gutter from a fascia board without any separate fasteners.

According to another aspect of the present disclosure, a gutter hanger and covering system is provided for hanging a gutter from a fascia board and covering an open top of the gutter, wherein the gutter has a front gutter wall including a gutter lip, a bottom gutter wall, and a rear gutter wall. The gutter hanger and covering system comprises a dual-purpose gutter guard comprising a front connection structure, a central portion, and a rear connection structure. The front connection structure is configured to connect to the gutter lip. The rear connection structure is configured to connect to the rear gutter wall. The central portion is sized and shaped to cover a first portion of the open top of the gutter. The central portion defines openings for water passage and debris filtration. The rear connection structure is configured to be fastened to the fascia board. When (i) the front connection structure is connected to the gutter lip, (ii) the rear connection structure is connected to the rear gutter wall, and (iii) the rear connection structure is fastened to the fascia board: the dual-purpose gutter guard is configured to hang the gutter from the fascia board without separate gutter hangers. The gutter hanger and covering system further comprises a non-hanger covering panel comprising a front portion, a central portion, and a rear portion. The non-hanger covering panel is shaped differently in profile than the dual-purpose gutter guard. The non-hanger covering panel is configured to be installed on the gutter adjacent the dual-purpose gutter guard such that the front portion is located adjacent the gutter lip, the rear portion is located adjacent the rear gutter wall, and the central portion covers a second portion of the open top of the gutter beside the first portion. The central portion of the non-hanger covering panel defines openings for water passage and debris filtration.

According to other aspects of the present disclosure, the gutter hanger and covering system may include one or more of the following features. The front portion of the non-hanger covering panel may have a different profile than the front connection structure of the dual-purpose gutter guard. The front connection structure of the dual-purpose gutter guard may be configured to clip into the gutter lip from below and the front portion of the non-hanger covering panel may be configured to lie on top of the gutter lip. The front portion of the non-hanger covering panel may be configured to releasably engage the gutter lip such that the front portion of the non-hanger covering panel is selectively disconnectable from the gutter lip while the front connection structure remains connected to the gutter lip. The rear portion of the non-hanger covering panel may have a different profile than the rear connection structure of the dual-purpose gutter guard. The rear connection structure of the dual-purpose gutter guard may comprise a clip configured to clip onto the rear gutter wall and the rear portion of the non-hanger covering panel may comprise a terminal upturned flange configured for non-clipped face-to-face engagement with the rear gutter wall. The rear portion of the non-hanger covering panel may be configured to releasably engage the rear gutter wall such that the rear portion of the non-hanger covering panel is selectively disconnectable from the rear gutter wall and the fascia board while the rear connection structure remains connected to the front gutter wall and the fascia board. The central portion of the non-hanger covering panel and the central portion of the dual-purpose gutter guard may have corresponding profiles such that the central portion of the non-hanger covering panel is configured to conformingly engage the central portion of the dual-purpose gutter guard along an overlap. The non-hanger covering panel may be selectively removable from the gutter while the dual-purpose gutter guard hangs the gutter from the fascia board. The non-hanger covering panel may be configured to be installed on the gutter after being field-cut at a miter angle. The front portion of the non-hanger covering panel may comprise an up leg extending upward from the central portion and a terminal horizontal flange extending forward from the up leg, wherein the terminal horizontal flange is configured to lie on top of the gutter lip. The rear portion of the non-hanger covering panel may comprise a terminal upturned flange configured for non-clipped face-to-face engagement with the rear gutter wall. The central portion of the non-hanger covering panel and the central portion of the dual-purpose gutter guard may have corresponding undulating profiles, such that the non-hanger covering panel is configured to overlap the dual-purpose gutter guard at an overlap where the central portion of the non-hanger covering panel conformingly engages the central portion of the dual-purpose gutter guard, the terminal upturned flange is positioned in front of the rear connection structure in face-to-face contact therewith, and the front portion of the non-hanger covering panel and front connection structure engage opposite sides of the gutter lip. The rear connection structure may comprise a front portion, a rear portion, and an upper crease connecting the front portion to the rear portion. The rear connection structure may be configured to receive the top edge margin of the rear gutter wall between the front portion and the rear portion. The front portion of the rear connection structure may comprise a protruding screw section. The terminal upturned flange may comprise a protruding screw section configured to engage the protruding screw section of the rear connection structure in nested relation therewith at the overlap.

According to another aspect of the present disclosure, a method of providing guttering for a building is provided. The method comprises installing at least one dual-purpose gutter guard on at least one length of gutter by engaging a front connection structure of each dual-purpose gutter guard with a gutter lip of the respective gutter. The method further comprises hanging each gutter from a respective fascia board of the building by fastening a rear connection structure of the at least one dual-purpose gutter guard installed thereon to the fascia board, wherein the guttering is supported on the building by said at least one dual-purpose gutter guard without separate gutter hangers. The method further comprises installing a non-hanger covering panel having a different profile than each dual-purpose gutter guard on at least one gutter such that the non-hanger covering panel covers a different portion of the gutter than the at least one dual-purpose gutter guard installed on said gutter.

According to other aspects of the present disclosure, the method may include one or more of the following features. Said installing the non-hanger covering panel may be performed after said hanging. Said installing the non-hanger covering panel may comprise cutting a first non-hanger covering panel on a first miter and a second non-hanger covering panel on a second miter and joining the first non-hanger covering panel and the second non-hanger covering panel at a miter joint. Said installing the non-hanger covering panel may comprise overlapping an edge margin of the non-hanger covering panel with an edge margin of the at least one dual-purpose gutter guard installed on the respective gutter. Said installing the non-hanger covering panel may further comprise laying a front portion of the non-hanger covering panel on top of a gutter lip of the respective gutter. Said installing the non-hanger covering panel may further comprise engaging a rear portion of the non-hanger covering panel in non-clipped, face-to-face engagement with a rear gutter wall.

According to another aspect of the present disclosure, a method of inspecting guttering is provided. The method comprises, while the guttering is supported on the building by said at least one dual-purpose gutter guard without separate gutter hangers, removing the non-hanger covering panel to expose said different portion of the gutter that was covered by the non-hanger covering panel and inspecting the guttering through the exposed different portion of the gutter.

According to another aspect of the present disclosure, a method of cleaning guttering is provided. The method comprises, while the guttering is supported on the building by said at least one dual-purpose gutter guard without separate gutter hangers, removing the non-hanger covering panel to expose said different portion of the gutter that was covered by the non-hanger covering panel and cleaning the guttering through the exposed different portion of the gutter.

Other aspects and features will be apparent hereinafter.

BRIEF DESCRIPTION OF THE DRAWINGS

Corresponding reference characters indicate corresponding parts throughout the drawings.

DETAILED DESCRIPTION

This disclosure generally pertains to a gutter hanger and covering system that can be used to simultaneously hang a gutter from a fascia board and cover an open top of the gutter. The gutter hanger and covering system includes a dual-purpose gutter guard, and can optionally include an overlay panel. The gutter hanger and covering system is configured to alleviate dangers and difficulties the inventors have recognized in installing conventional gutter systems. Suitably, the gutter hanger and covering system of the present disclosure enables an installer to almost fully assemble and reinforce the gutter on the ground, thereby minimizing installation processes performed on a ladder at the height of the fascia board on a roof.

Figure 1:
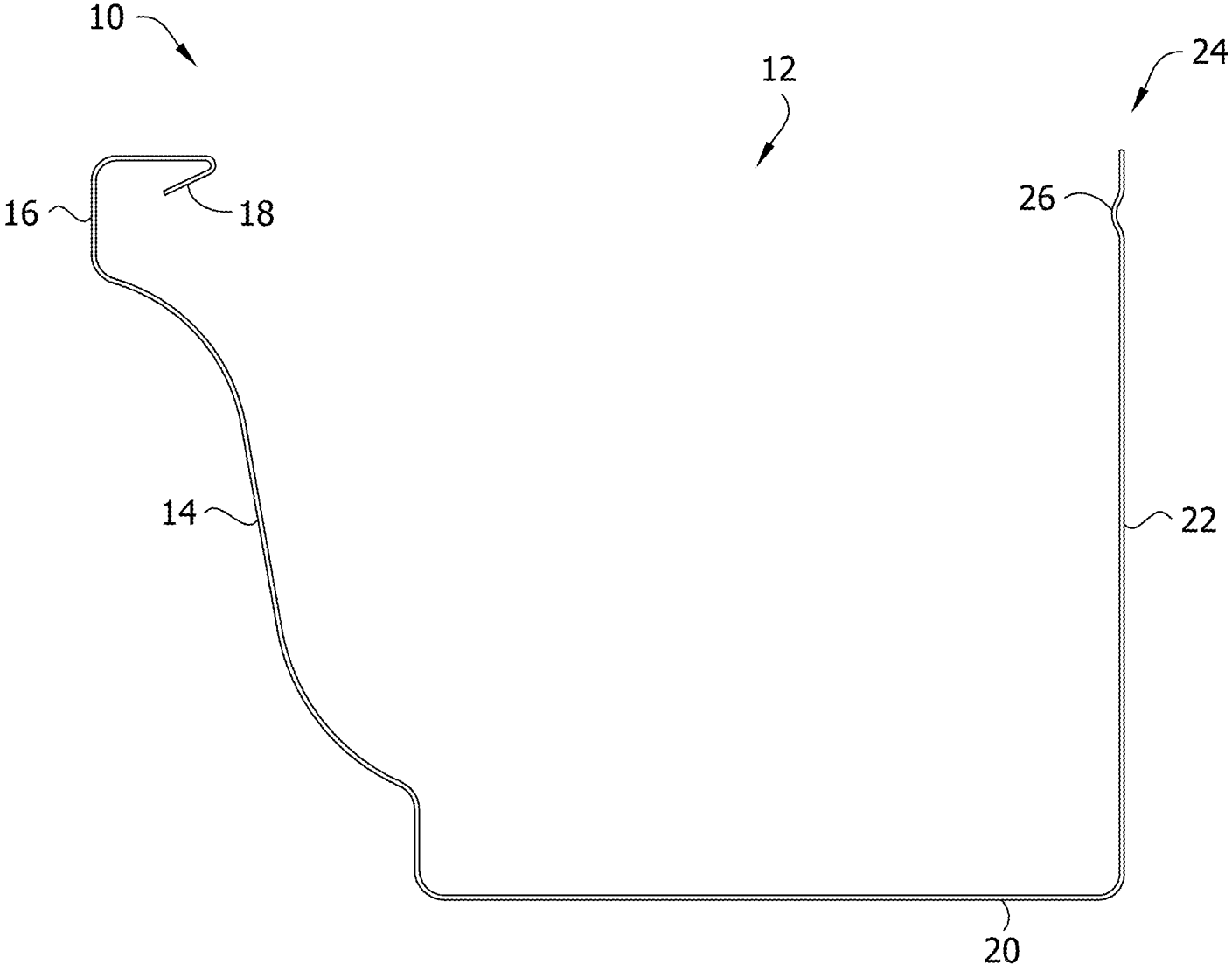
FIG. 1 is a cross-section of a gutter.

Referring now to FIG. 1, a typical gutter is generally indicated at reference number 10. The gutter 10 depicted in FIG. 1 represents a six-inch gutter of the seamless gutter type. It will be understood, however, that the gutter hanger and covering system of the present disclosure can also be used with other size gutters, such as five-inch gutters, without departing from the scope of the disclosure. The gutter 10 includes an open top 12, a front gutter wall 14 including a gutter lip 16 and gutter hem 18, a bottom gutter wall 20, and a rear gutter wall 22 including a top edge margin 24 and a bead 26. Those skilled in the art will recognize that some seamless gutters lack the bead 26 on the rear gutter wall.

Figure 2:
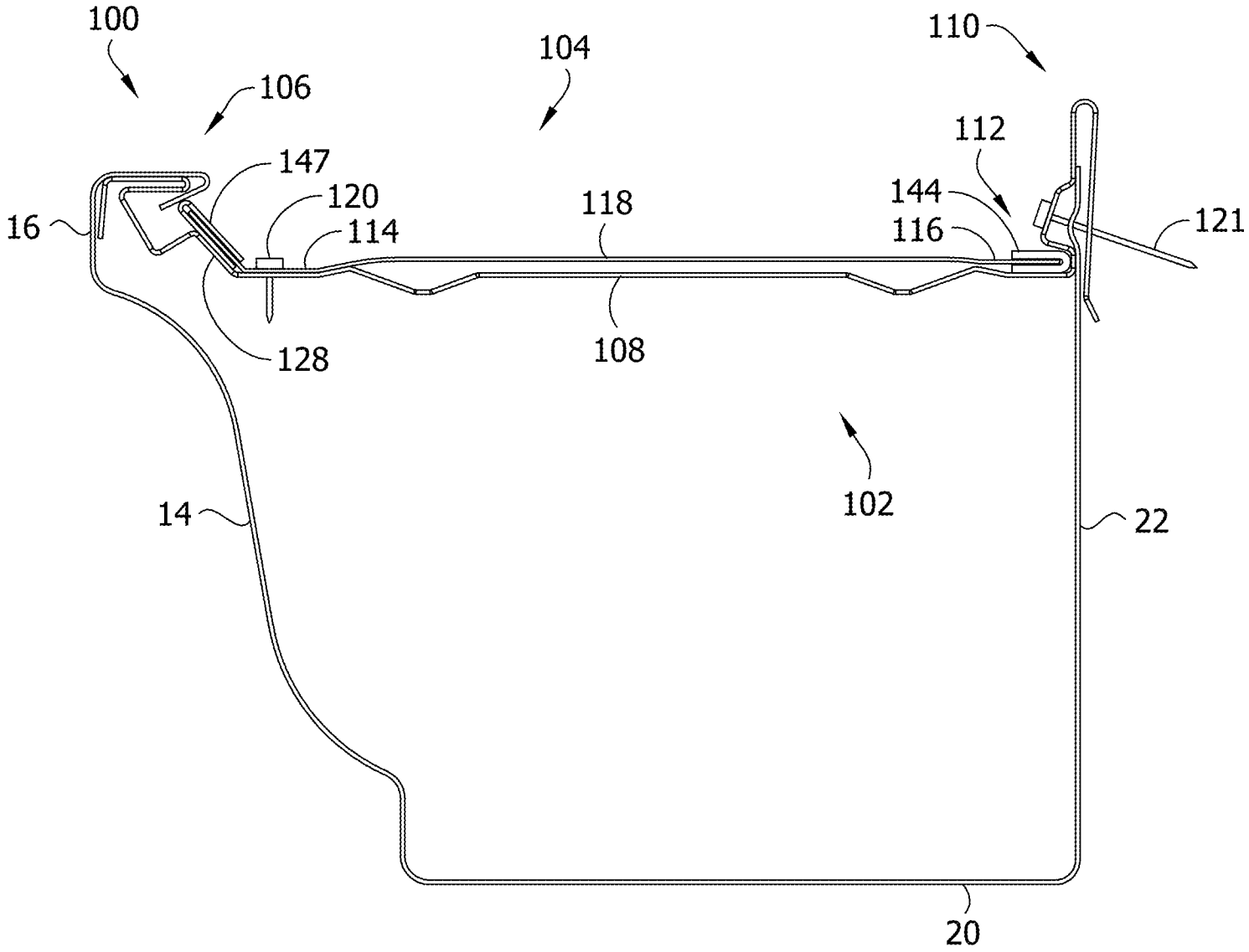
FIG. 2 is a cross-section of a gutter hanger and covering system installed on the gutter of FIG. 1.
Figure 3:
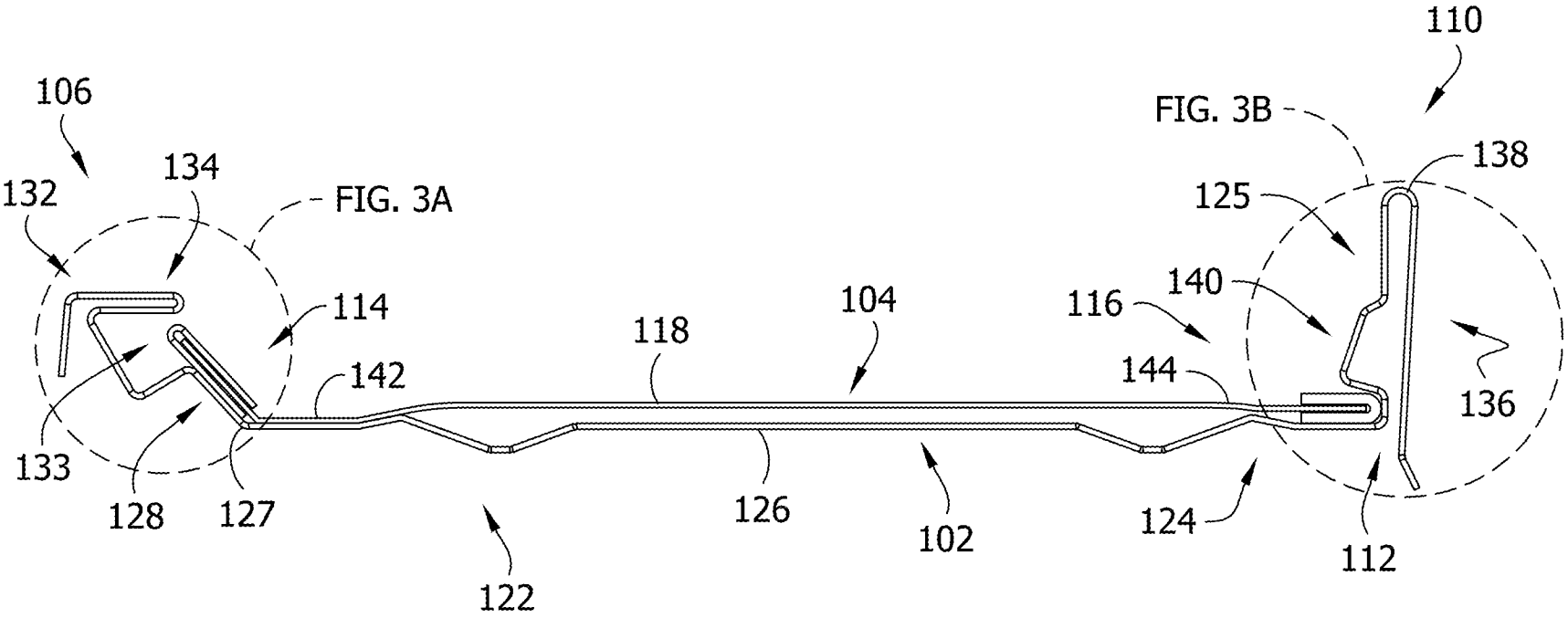
FIG. 3 is a cross-section of a gutter guard and overlay panel of the gutter hanger and covering system of FIG. 2.

Referring to FIG. 2, an example embodiment of a gutter hanger and covering system installed on the gutter 10 is generally indicated at reference number 100. The gutter hanger and covering system 100 broadly comprises a dual-purpose gutter guard 102 and an optional overlay panel 104. Referring also to FIG. 3, the dual-purpose gutter guard 102 includes a front connection structure 106, a central portion 108, and a rear connection structure 110. In the illustrated embodiment the front connection structure 106, the central portion 108, and the rear connection structure 110 are formed from a single piece of monolithic sheet metal. But it will be understood that, in other embodiments, the front connection structure 106, the central portion 108, and/or the rear connection structure 110 could be formed from individual pieces that are attached to one another to make the dual-purpose gutter guard 102.

The dual-purpose gutter guard 102 is configured to connect to the gutter 10 such that the front connection structure 106 couples to the gutter lip 16, the rear connection structure 110 couples to the rear gutter wall 22, and the central portion 108 covers the open top 12 of the gutter and defines first openings 500 (see FIG. 5) for water passage and debris filtration. The optional overlay panel 104 includes a front end portion 114, a rear end portion 116, and a central portion 118 extending from the front end portion to the rear end portion. In general, the overlay panel 104 is configured to mount on the dual-purpose gutter guard 102 such that the overlay panel covers the first openings 500, and the rear end portion 116 fits into the overlay receiving channel 112. Furthermore, the central portion 118 of the overlay panel 104 includes second openings 600 (see FIG. 6) that provide additional (finer) debris filtration. Additionally, the gutter hanger and covering system 100 may include a first set of screws 120 configured to screw the front end portion 114 of the overlay panel 104 onto the central portion 108 of the dual-purpose gutter guard 102 and a second set of screws 121 used to secure the rear connection structure 110 to the rear gutter wall 22 during preassembly and then to hang the gutter 10 from the fascia board with the gutter is installed on the fascia. Individual components of the gutter hanger and covering system 100 will now be described before turning to example methods of installing the system to hang and cover the gutter 10.

Figure 4:
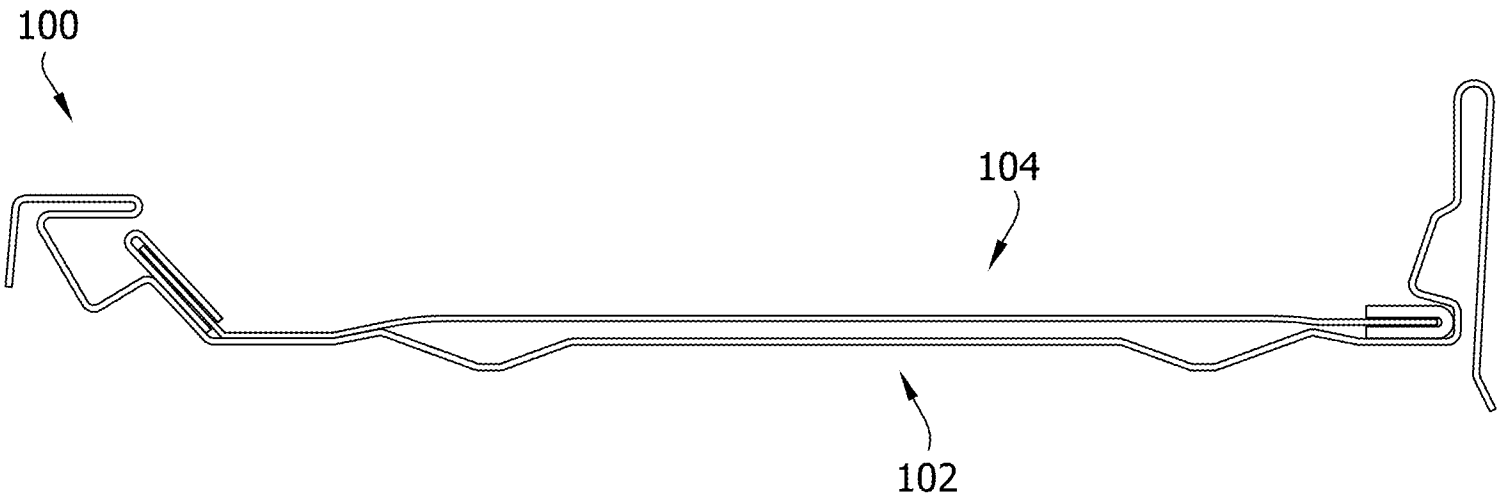
FIG. 4 is a cross-section of a gutter guard and overlay panel.

The central portion 108 of the dual-purpose gutter guard 102 is configured to cover the open top 12 of the gutter 10 when the gutter guard is installed on the gutter. The central portion 108 comprises a front segment 122 (FIG. 3) connected to the front connection structure 106, a rear segment 124 connected to the rear connection structure 110, and a primary covering section 126 between the front and rear segments. The primary covering section 126 extends from the front segment 122 to the rear segment 124 for covering most of the open top 12 of the gutter 10. The primary covering section 126 is shaped and arranged to extend generally horizontally across the top of the gutter 10, but may also include a plurality of discrete undulations (e.g., strengthening ribs and/or surface tension breakers). For example, FIGS. 2 and 3 show the primary covering section 126 shaped and arranged to include one configuration of undulations whereas FIG. 4 shows an alternative configuration of undulations. The rear segment 124 is connected to the rear connection structure 110 at the overlay receiving channel 112.

In an example embodiment, the front segment 122 of the central portion 108 comprises an angled debris lifter 128 extending forward and upward from the primary covering section 126, toward the front connection structure 106. In general, the angled debris lifter 128 is configured to force debris that falls onto the gutter hanger and covering system 100 over the front gutter lip 16 of the gutter 10. The angled debris lifter 128 connects to the primary covering section 126 at a bend 127. Particularly, the bend 127 transitions the dual-purpose gutter guard 102 from a front covering segment of the primary covering section 126 to the angled debris lifter 128, such that an included angle 129 (shown in Detail A in FIG. 3A) between the angled debris lifter and the front covering segment above the dual-purpose gutter guard 102 is in an inclusive range from about 120° to 160°. In the illustrated embodiment, the angled debris lifter 128 comprises an apex 130, and has angled debris lifter height 131 from the bend 127 to the apex. Suitably, the angled debris lifter height 131 is greater than ¼". Moreover, the apex 130 defines an included angle 139 below the dual-purpose gutter guard 102 in an inclusive range from about 80° to 150°. It will be appreciated that the debris lifter can have other configurations and, in some embodiments, can be omitted without departing from the scope of the present disclosure.

In general, the front connection structure 106 of the dual-purpose gutter guard 102 is configured to couple to the front gutter lip 16 for hanging the gutter 10 from a fascia board without requiring separate fasteners for fastening the front connection structure to the gutter. Accordingly, the front connection structure 106 comprises a rearward projecting finger 132 that is configured to engage the gutter hem 18 of the front gutter lip 16. For example, the rearward projecting finger 132 tucks into the gutter hem 18 to couple the front connection structure 106 to the gutter lip 16. In the illustrated embodiment, the rearward projecting finger 132 comprises a tip 134 spaced apart from the apex 130 of the angled debris lifter 128 by a gap 133. The gap 133 has a dimension 135 extending from the tip 134 to the apex 130, and the dimension is less than ⅜", such as in an inclusive range of from about 0.18" to 0.28". Furthermore, the tip 134 is vertically spaced apart from the bend 127 by a height 137 of the finger 132, and suitably, the height 137 of the finger and the angled debris lifter height 131 differ by less than ⅜".

Figure 3A:
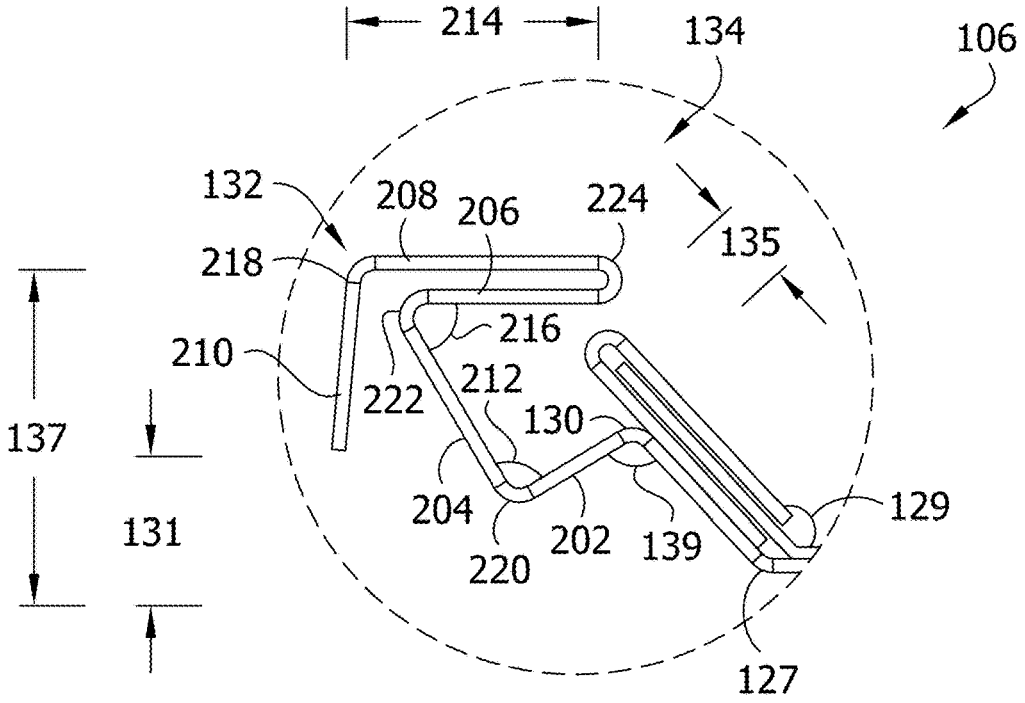
FIG. 3A is an enlarged view of a portion of FIG. 3.

In an example embodiment, the front connection structure 106 is shaped and arranged such that the front connection structure includes a plurality of segments (in profile) joined at bends. As shown in FIG. 3A, the front connection structure 106 including the rearward projecting finger 132 comprises a decline segment 202, an incline segment 204, a lower finger segment 206, an upper finger segment 208, and a downturned edge margin 210. The decline segment 202 extends forward and downward from the apex 130 to a lower bend 220. The lower bend 220 defines an included angle 212 above the lower bend in an inclusive range from about 80° to 150°. The incline segment 204 extends forward and upward from the lower bend 220 to a rearward bend 222. The lower finger segment 206 extends rearward from the rearward bend 222 to a finger crease 224. Suitably, the lower finger segment 206 has a front to back dimension 214 extending from the rearward bend 222 to the finger crease 224 in an inclusive range from about ¼" to ¾". The rearward bend 222 defines an included angle 216 rearward of the incline segment 204 and below the lower finger segment 206 in an inclusive range from about 20° to 60°. The upper finger segment 208 extends forward from the finger crease 224. The downturned edge margin 210 extends forward and downward from the upper finger segment 208 at a downturned bend 218 between the downturned edge margin and upper finger segment. It will be appreciated that other configurations of front connection structure can be used without departing from the scope of the present disclosure.

Figure 7:
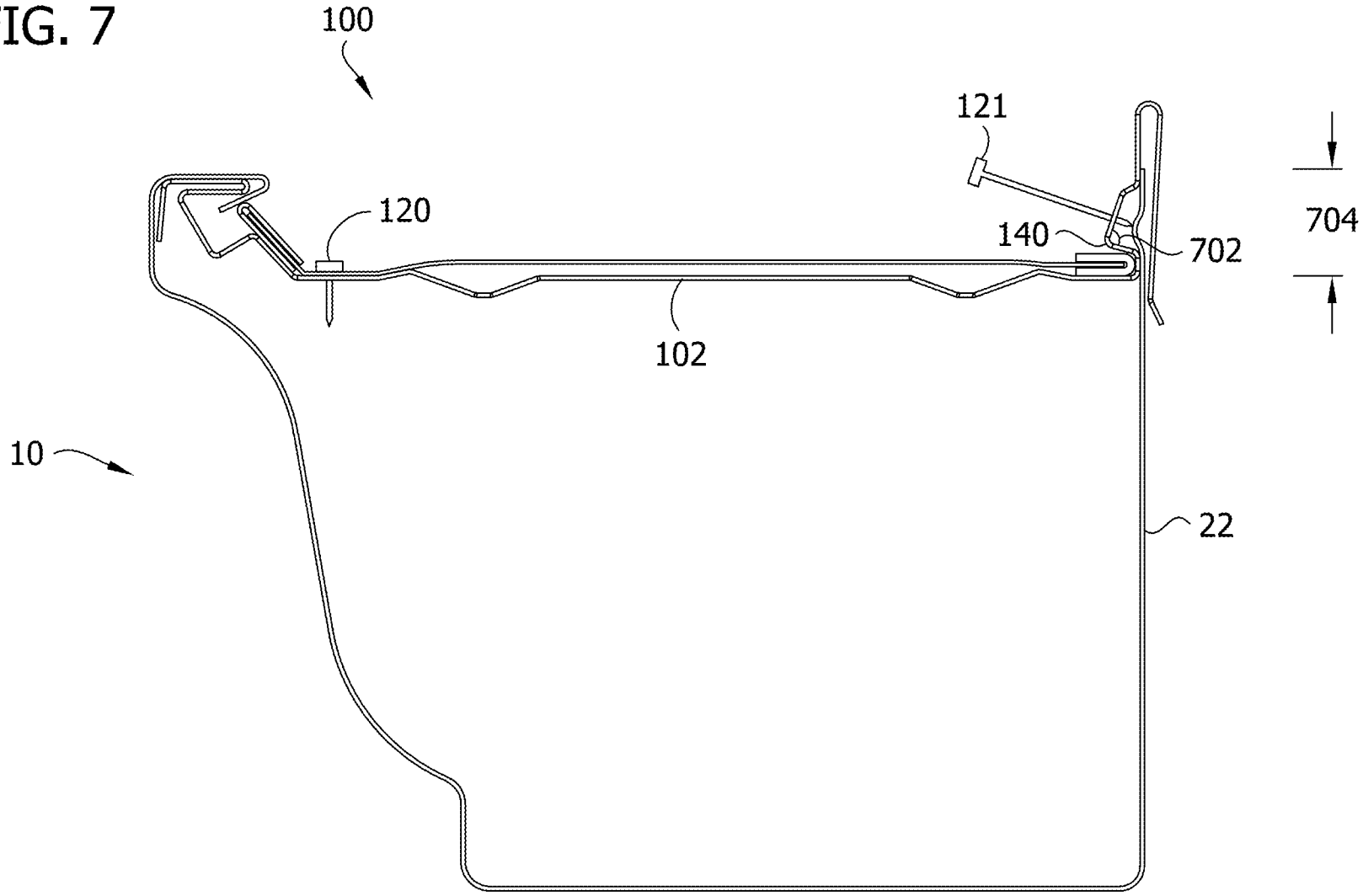
FIG. 7 is a cross-section of a gutter hanger and covering system pre-installed on the gutter of FIG. 1

In general, the rear connection structure 110 of the dual-purpose gutter guard 102 is configured to clip onto the top edge margin 24 of the rear gutter wall 22 of the gutter 10. Suitably, the rear connection structure 110 has a front portion 125, a rear portion 136, and an upper crease 138 connecting the front portion to the rear portion, such that the top edge margin 24 is at least partially received between the front and rear portions. The front portion 125 of the rear connection structure 110 comprises a screw section 140. Accordingly, the screw section 140 is positioned so as to be spaced apart in front of the top edge margin 24 of the rear gutter wall 22 when the rear connection structure 110 is clipped onto the top edge margin of the rear gutter wall. Moreover, the screw section 140 is configured to be spaced apart in front of the bead 26 of the top edge margin 24. Accordingly, the screw section 140 is configured so that the plurality of screws 121 can be advanced through the screw section at spaced apart locations along the length of the dual-purpose gutter guard 102. This can serve one or both of two purposes. First, it allows an installer to preinstall the screws 121 in the rear connection structure 110 on the ground, making it easier to drive the screws into the fascia board after the gutter 10 is lifted into place. Second, while the gutter 10 and gutter covering system 100 are still on the ground, the screws 121 can be advanced to first positions at which tip portions of the screws engage the top edge margin 24 of the rear gutter wall 22 as set screws, whereby the screws secure the connection of the rear connection structure 110 to the gutter. Securing the rear connection structure 110 to the rear gutter wall 22 in this way forms a reinforced gutter unit that stiffens the gutter 10 to resist sagging. The inventors believe this makes it easier for the installer to move the gutter 10 and dual-purpose gutter guard 102 together as a unit into position for installation on the fascia board (see FIG. 7). It will be appreciated that tips of the screws 121 can press against or pass through the rear gutter wall 22 to fasten the gutter guard 102 to the gutter 10 in advance of hanging the gutter and guard. In either case, for purposes of this disclosure, provided the screws 121 are not advanced to the point that the protrude meaningfully beyond the rear portion 136 of the rear connection structure 110, the screws are considered to be engaged with the rear gutter wall 22 as set screws.

The screw section 140 is angled downward and frontward from the rear portion 136 of the rear connection structure 110 and from the rear gutter wall 22 when the gutter guard 102 is installed on the gutter 10. In one or more embodiments, an included angle 702 between the screw section 140 and the rear gutter wall 22 is in an inclusive range of from 5° to 35°. During use, an installer will position each screw 121 at about the midpoint of the height of the screw section 140 and angle each screw so that it extends generally orthogonal to the plane of the screw section. In certain embodiment, the screw section 140 could be pre-formed with screw retainers (e.g., torn or punched openings of smaller cross sectional dimensions than the shafts of the screws 121, which aid the installer in properly locating the screws along the screw section. Accordingly, the angled screw section 140 directs an installer to easily and sufficiently install a screw through the front portion 125 of the rear connection structure 110 into engagement with the rear gutter wall 22. Furthermore, the angled screw section 140 is configured to provide drill clearance such that an installer may hold a drill for installing the screws in a downwardly angled position above the system 100 such neither the gutter lip 16 nor the shingles above the fascia board interfere with the drill during installation. Other configurations of screw sections can be used, and the screw section can be omitted, without departing from the scope of the present disclosure For example, it is expressly contemplated that in one or more embodiments, the polygonal screw section 140 can be replaced with a rounded or dome-shaped screw section. In addition, the screw section can be omitted so that the front section of the rear connection structure is substantially flat in cross section. In these embodiments, the rear connection structure can be button-punched (snap-lock punched) onto the rear gutter wall prior to hanging the gutter from the fascia board.

Figure 3B:
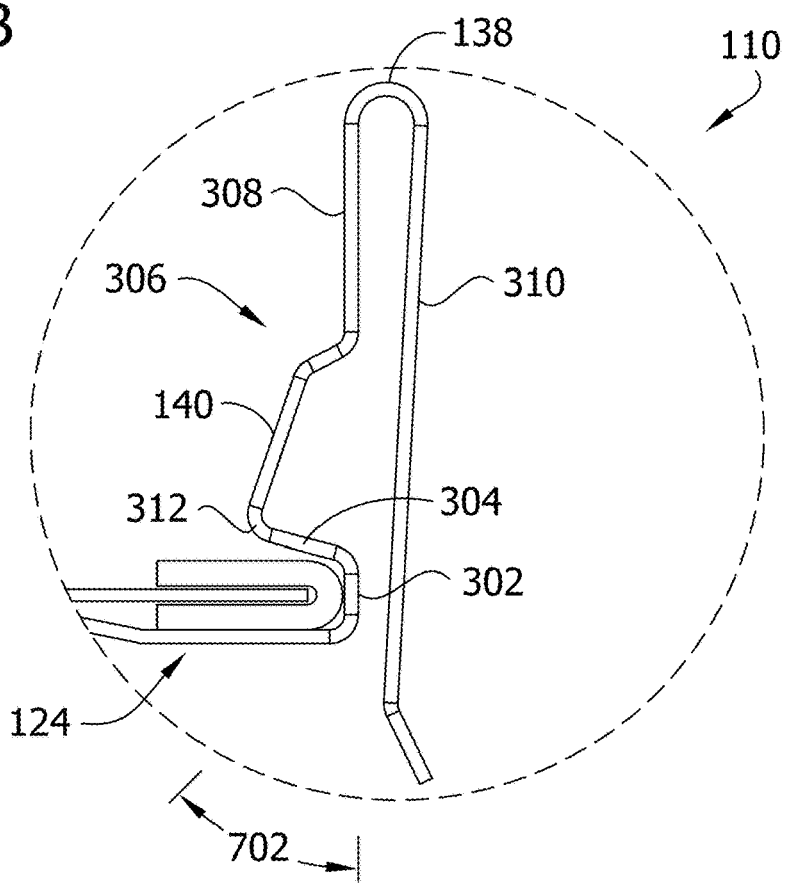
FIG. 3B is an enlarged view of another portion of FIG. 3.

As mentioned above, the rear connection structure 110 further includes the overlay receiving channel 112 configured for receiving the rear end portion 116 of the overlay panel 104. The overlay receiving channel 112 comprises a forward facing channel beneath the screw section 140. Referring to FIG. 3B, the forward facing channel broadly comprises a back side 302 and an upper segment 304. The upper segment 304 is configured to overlie the rear segment 124 of the central portion 108 and connect to the screw section 140. The back side 302 is configured to contact the top edge margin 24 of the rear gutter wall 22 when the rear connection structure 110 is clipped onto the top edge margin. In one example, the back side 302 is configured to contact the top edge margin 24 of the rear gutter wall 22 at a location that is spaced apart from the topmost edge of the rear gutter wall by a vertical spacing distance 704 in an inclusive range from about ⅛" to 1".

In an example embodiment the rear connection structure 110 is shaped and arranged such that the rear connection structure includes a plurality of segments separated by bends. The upper segment 304 connects to the screw section 140 at an upturned bend 312. The upturned bend 312 is forwardly spaced from the back side 302 of the forward facing channel. The screw section 140 extends at an upward and rearward angle from the upturned bend 312 to a backward joggle 306. The upper flange 308 extends upward from the backward joggle 306 to the upper crease 138. Accordingly, the upper flange 308 is configured to contact the top edge margin 24 of the rear gutter wall 22. The joggle 306 is less pronounced than the bends from the upper segment 304 of the overlay receiving channel 112. During use, when an installer drives the screws 121 into the fascia board, the joggle 306 will tend to collapse so that the screw section 140 is pressed tight against the rear gutter wall 22 received in the rear connection structure 110. A downturned edge margin 310 extends downward from the upper crease 138 and may terminate in an optional backward kicker.

The back side 302 of the forward facing channel defines a nose protruding into a gutter receiving space defined by the rear connection structure 110. In one example, the upper flange 308 and nose are configured to contact the top edge margin 24 of the rear gutter wall 22 on opposite sides of the bead 26. In one embodiment, the nose and the downturned edge margin 310 are sufficiently close (e.g., minimally spaced or engaging each other) to interfere with insertion of the gutter bead 26 into the gutter receiving space of the rear connection structure 110. For example, as the rear gutter wall 22 is moved upward into the gutter receiving space, the bead 26 cams on the nose and momentarily opens the rear connection structure 110 by expanding the upper crease 138 as a resilient living hinge. After the bead 26 has passed the nose, the downturned edge margin 310 resiliently returns toward its at-rest position such that the rear connection structure 110 is "clipped" onto the rear gutter wall 22 and the nose then interferes with the bead from being withdrawn from the gutter receiving space. Other configurations of rear connection structure can be used without departing from the scope of the present disclosure.

Figure 5:
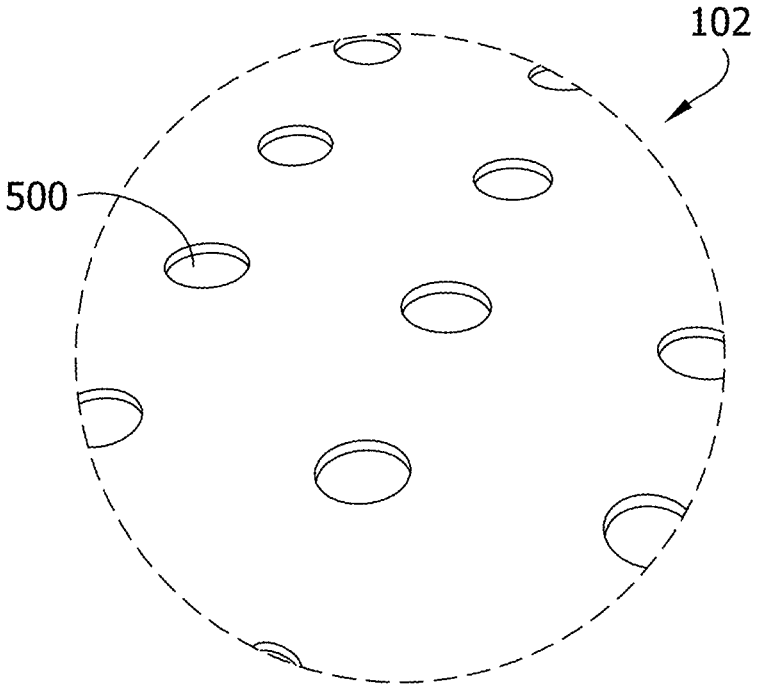
FIG. 5 is fragmentary perspective of a portion of the gutter guard.

It is contemplated that the dual-purpose gutter guard 102 is formed by bending an at least partially perforated single piece of sheet metal (e.g., mill finished, painted, or powder coated aluminum or steel sheet metal). Accordingly, the sheet metal defines first openings 500 configured for filtering debris and promoting water passage therethrough. FIG. 5 provides an example of material used to form the dual-purpose gutter guard 102 and is representative of one suitable type of first openings 500, though it will be understood that the dual-purpose gutter guard could be formed from other types of materials (e.g., expanded metal mesh) and/or materials having other types of first openings (e.g., louvered openings, openings of non-circular shapes such as square-shaped, triangle-shaped, and/or teardrop-shaped openings) without departing from the scope of the disclosure. In one or more embodiments, the first openings 500 are formed in repeating pattern along the central portion 108, but not the front connection structure 106 and rear connection structure 110. In certain embodiments, there are no first openings 500 along the debris lifter 128.

Suitably, the length of each gutter guard 102 can be in an inclusive range from about two feet to ten feet, typically three feet to eight feet, and in one example embodiment, about 7.5 feet. A plurality of gutter guards 102 can be arranged in series to cover any contiguous length of a gutter 10. As used herein, an arrangement "in series" means the gutter guards 102 are positioned sequentially along the length of the gutter, wherein the end portions of adjacent gutter guards may be engaged at an edge-to-edge butt joint or at an overlap joint. Although the gutter guard 102 is described herein as dual-purpose (guard and hanger), it will be appreciated that aspects of the gutter guard can be incorporated in single-purpose products (e.g., gutter guards or gutter hangers) without departing from the scope of the present disclosure.

Figure 6:
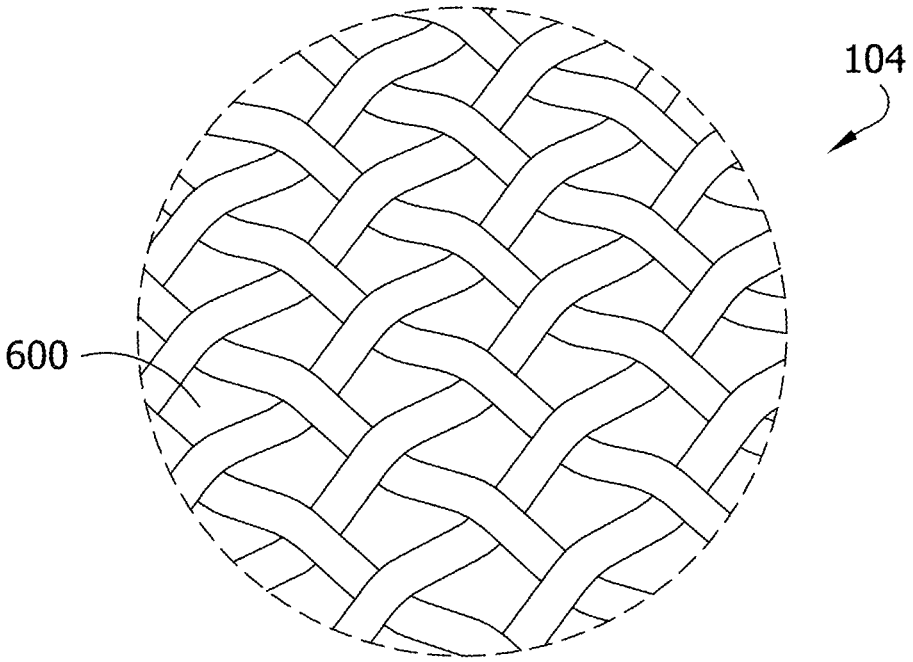
FIG. 6 is an enlarged fragmentary perspective of a portion of the overlay panel.

The overlay panel 104 is configured to mount on top of the dual-purpose gutter guard 102 to provide additional debris filtration through the second openings 600 defined by the overlay panel. In one example, the overlay panel 104 comprises woven wire mesh that defines the second openings 600. In other examples, the overlay panel can comprise other structures (e.g., sheet metal, plastic, expanded metal, non-woven mesh or screen, etc.) defining second openings of any suitable shape (e.g., slotted openings, etc.). The second openings 600 are smaller openings than the first openings 500. FIG. 6 provides an example of material used to form the overlay panel 104. The smaller sized openings 600 provide a finer level of debris filtration than the openings 500 in the dual-purpose gutter guard 102. In one or more embodiments, the overlay panel 104 is an optional component that may be used selectively at locations where finer debris filtration is wanted (e.g., gutter segments that are in the debris field of a needled or fine-leafed tree). In an example embodiment, the overlay panel 104 comprises a sheet of stainless steel woven wire mesh that forms the central portion 118, a front sheet metal flange 142 crimped onto the sheet of woven wire mesh that forms the front end portion 114, and a rear sheet metal flange 144 crimped onto the sheet of woven wire mesh that forms the rear end portion 116. Other configurations of overlay panels can be used, and the overlay panel can be omitted, without departing from the scope of the present disclosure.

The rear end portion 116 of the overlay panel 104 is configured to be retained within the overlay receiving channel 112 to secure the rear end portion to the dual-purpose gutter guard 102. The sheet metal flange 144 suitably fits tightly inside the overlay receiving channel 112 (e.g., by an interference or friction fit).

The front end portion 114 of the overlay panel 104 is configured to rest on the dual-purpose gutter guard 102 adjacent the front connection structure 106 when the rear end portion 116 of the overlay panel is retained within the overlay receiving channel 112. Suitably, the overlay panel 104 is dimensioned so that, when the rear end portion 116 is fitted into the overlay receiving channel 112, the front end portion 114 of the overlay panel 104 is pressed against the debris lifter 128. In an example embodiment, the overlay panel 104 is dimensioned so that, when the rear end portion 116 is fitted into the overlay receiving channel 112, the front end portion 114 substantially covers the gap 133. For example, the front edge of the front flange 142 may contact the gutter lip 16.

The front end portion 114 may be secured to the dual-purpose gutter guard 102 by installing screws 120 through the woven wire mesh adjacent the sheet metal profile. In FIG. 2, the screws 120 are installed along the front segment 122 of the central portion 108. In an example embodiment, the overlay panel 104 is pre-manufactured with a bend between the front flange 142 and the central portion 118. The pre-manufactured bend is suitably more open than the bend between the front flange 142 and the central portion 118 after the screws 120 are installed. In this way, installing the screws bends the overlay panel 104 at the pre-manufactured bend to create spring pressing that maintains contact between the front flange 142 and the debris lifter 128 and gutter lip 16.

A method of using the gutter hanger and covering system 100 is further described in detail below. The method involves using the gutter hanger and covering system 100 to hang the gutter 10 from a fascia board while simultaneously covering the open top 12 of the gutter.

Initially, one or more dual-purpose gutter guards 102 are installed on the gutter 10 by engaging the front connection structure 106 of each of the dual-purpose gutter guards with the front gutter lip 16, and connecting (e.g., clipping) the rear connection structure 110 of each of the dual-purpose gutter guards onto the top edge margin 24 of the rear gutter wall 22. In one example, the gutter 10 is at least 20 feet long and a plurality of dual-purpose gutter guards 102 are arranged in series to cover at least a contiguous 20-ft length of the gutter. It will of course be understood that the dual-purpose gutter guards 102 of the present disclosure can be arranged in series and/or cut to length to cover any length of guttering one mind desire on a building. In an example embodiment, as shown in FIG. 8, installing the dual-purpose gutter guards 102 on the gutter 10 involves orienting each dual-purpose gutter guard 102 in an upright orientation with respect to the gutter 10 with the finger generally below the front lip of the gutter adjacent the front edge of the hem 18, and then rotating each dual-purpose gutter guard downward toward an installed position.

Figure 8:
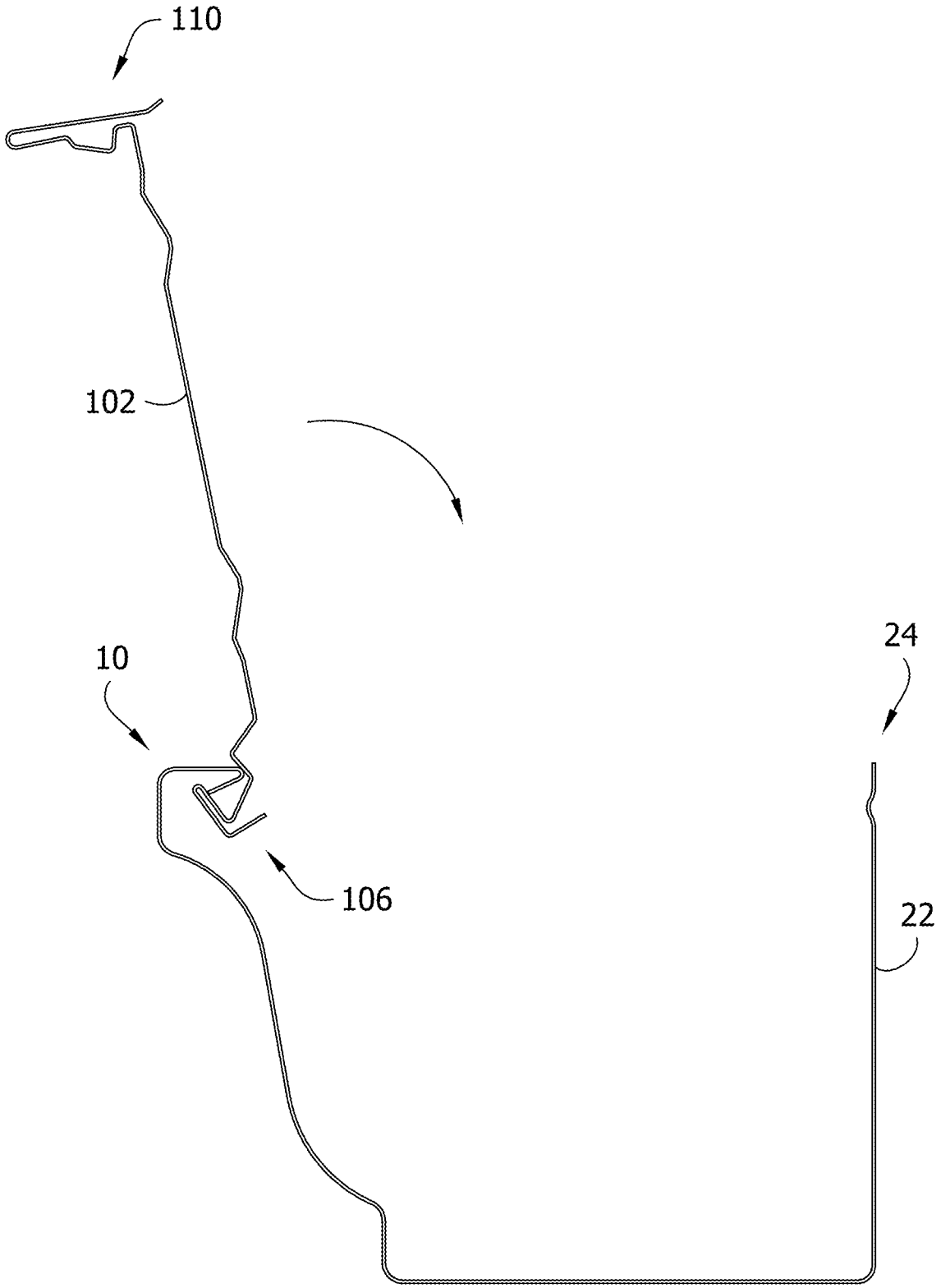
FIG. 8 is a schematic cross-section illustrating the gutter guard of FIG. 3 being installed on the gutter of FIG. 1.
Figure 9:
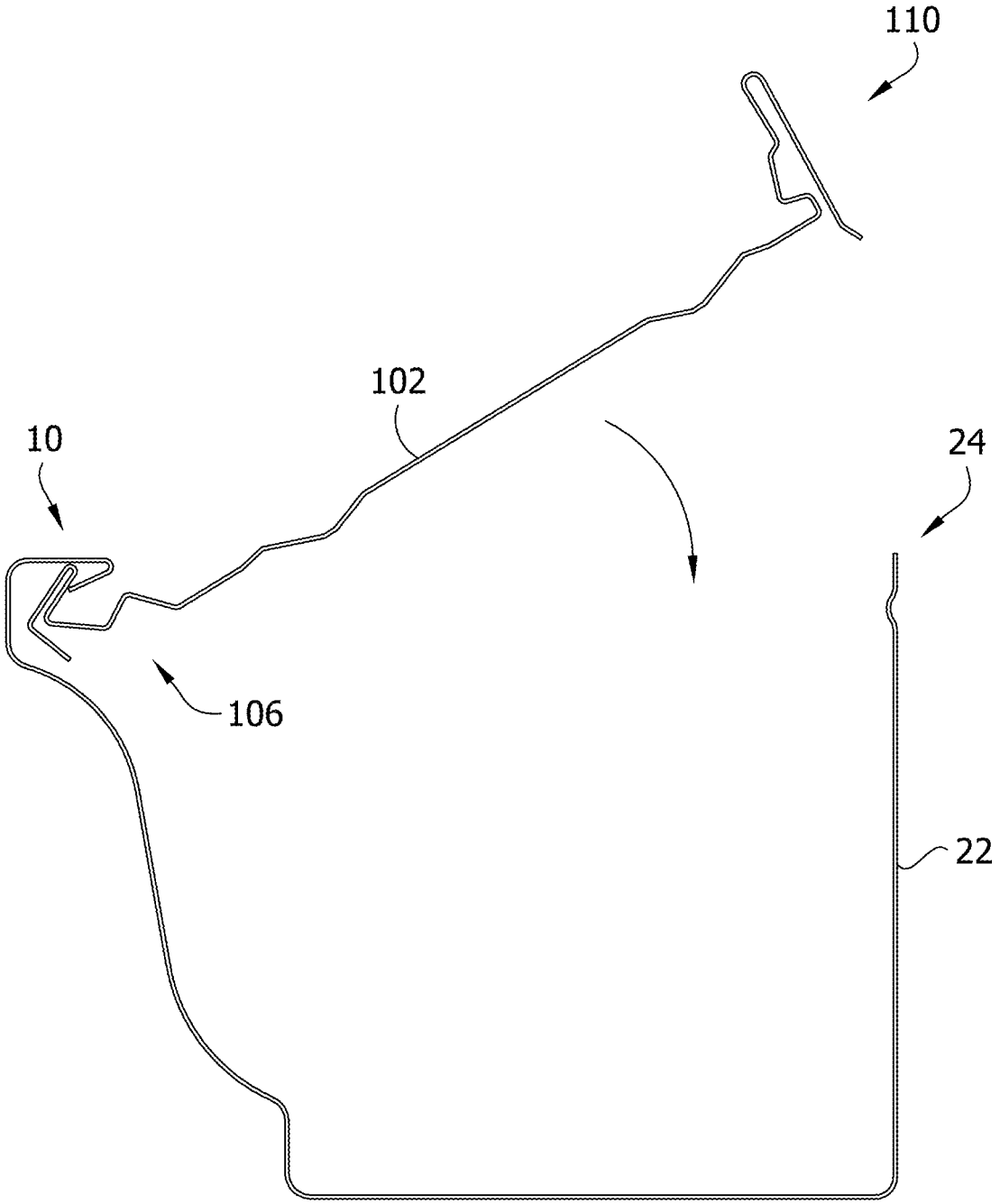
FIG. 9 is another schematic cross-section illustrating the gutter guard of FIG. 3 being installed on the gutter of FIG. 1.
Figure 10:
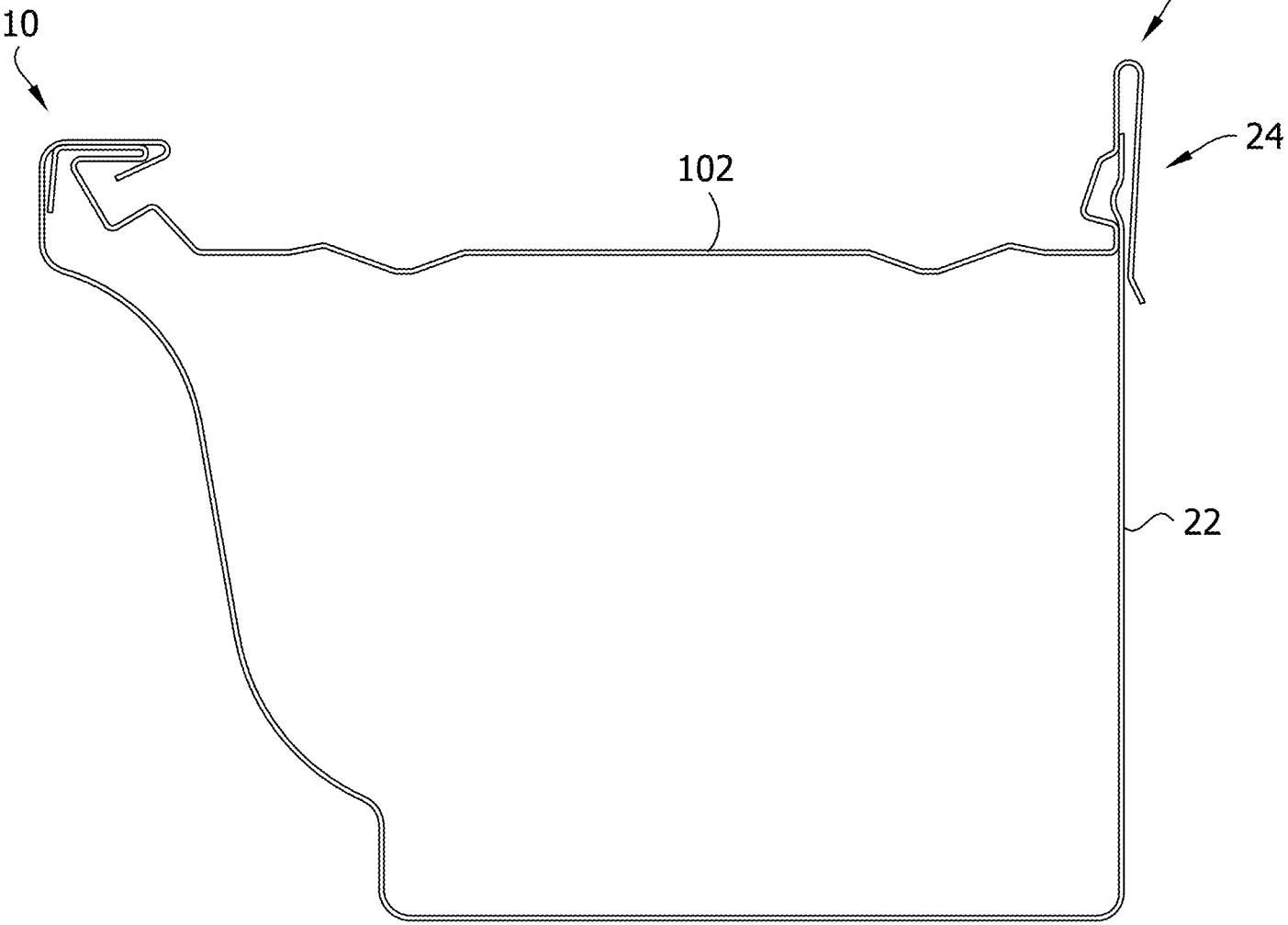
FIG. 10 is a schematic cross-section illustrating the gutter guard of FIG. 3 installed on the gutter of FIG. 1.
Figure 20:
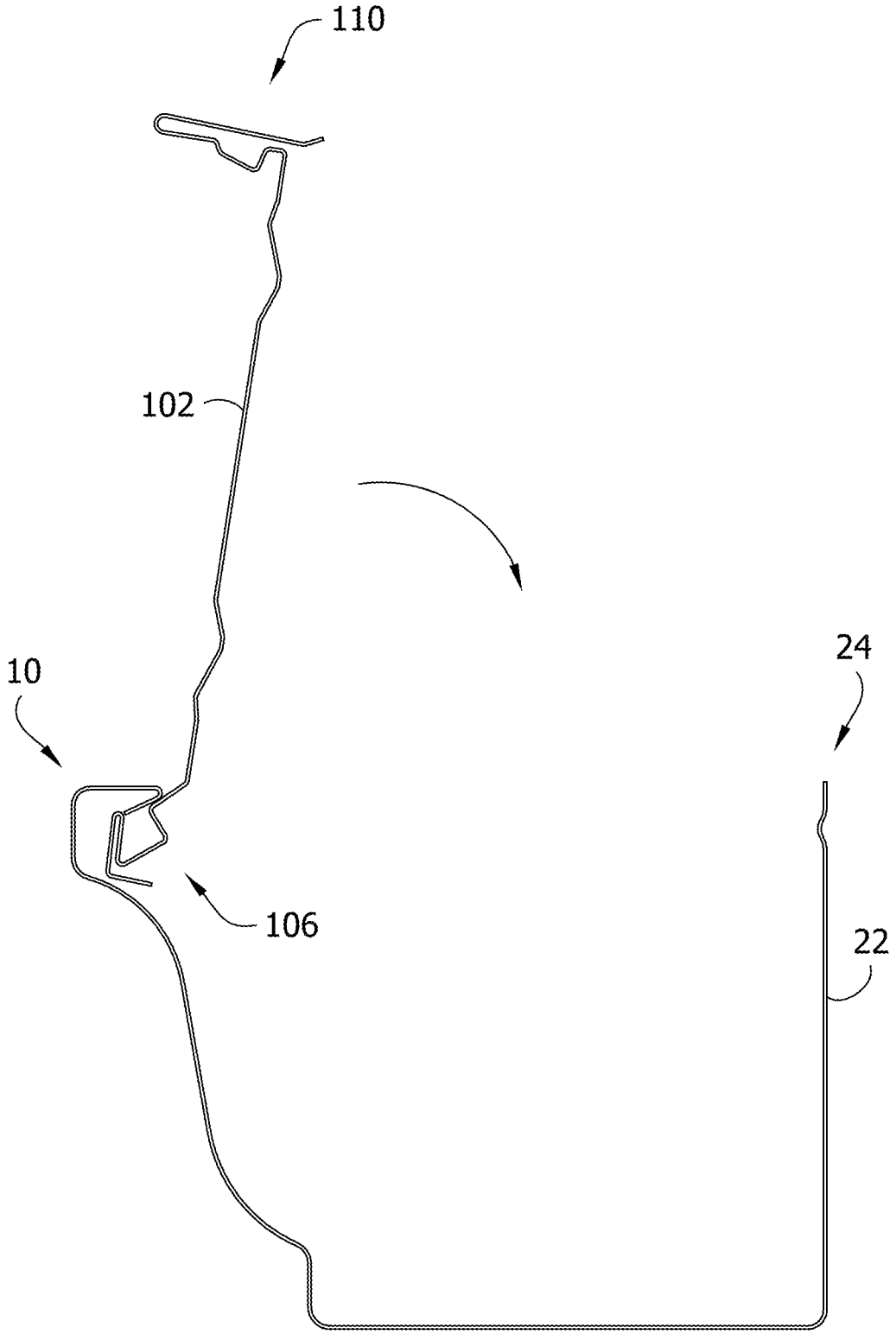
FIG. 20 is a schematic cross-section similar to FIG. 9 illustrating the gutter guard of FIG. 3 being installed on another gutter.
Figure 21:
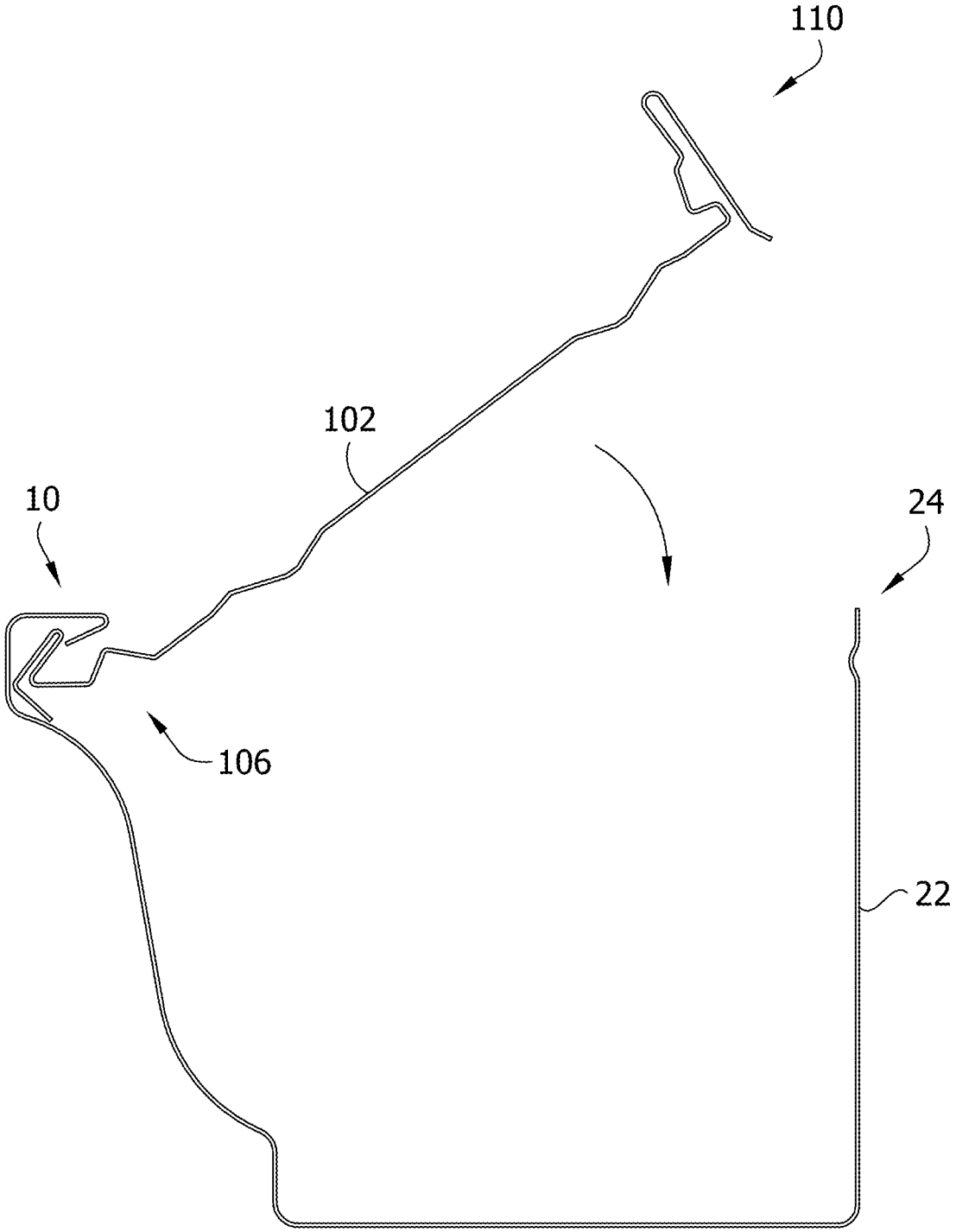
FIG. 21 is a schematic cross-section similar to FIG. 20 showing the gutter guard rotated downward from the position in FIG. 20.
Figure 22:
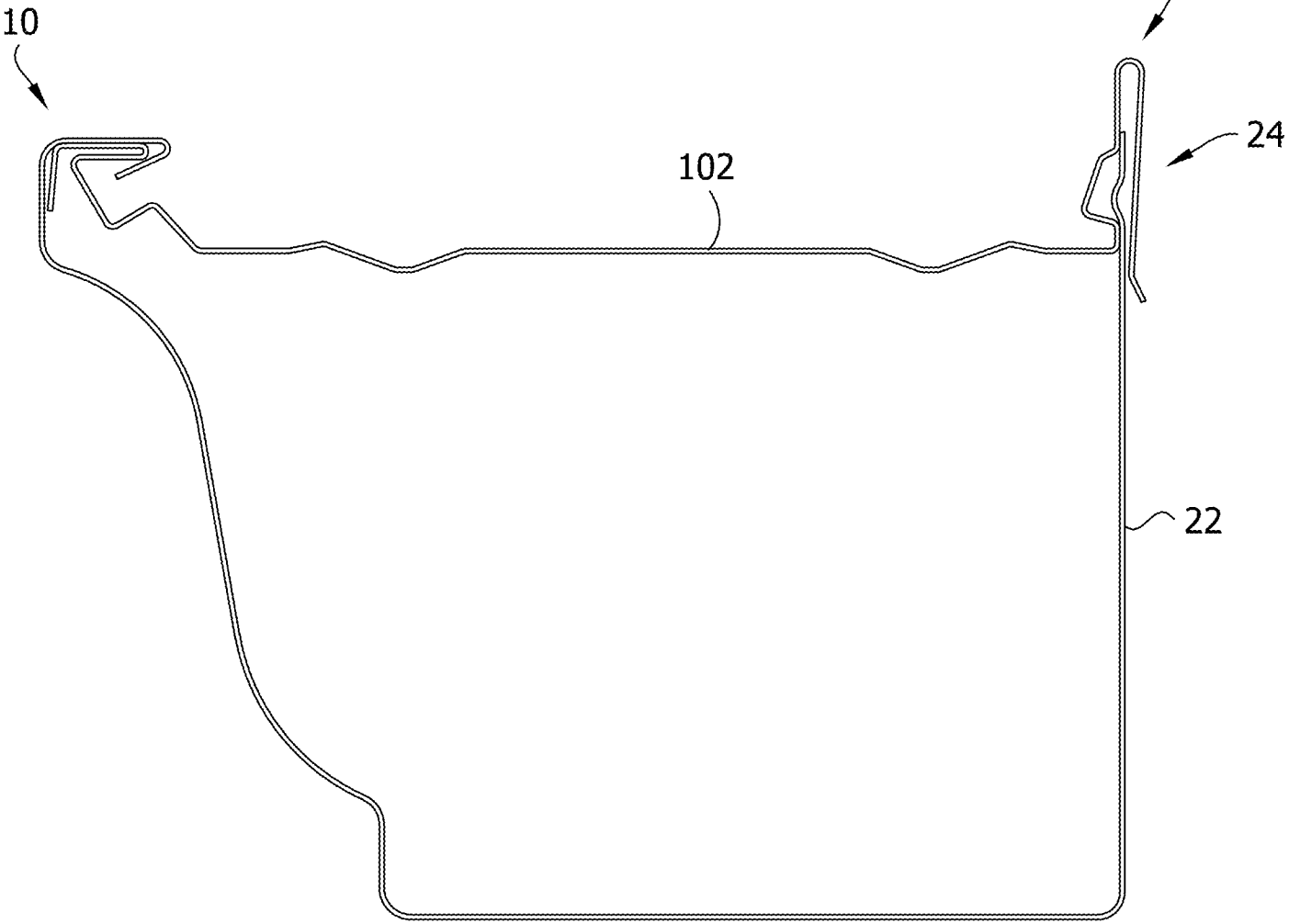
FIG. 22 is a schematic cross-section similar to FIGS. 20 and 21 showing the gutter guard installed on the gutter.

Referring to FIGS. 8-10 and also to FIGS. 20-22, the front connection structure is arranged so that, as the dual-purpose gutter guard 102 is rotated downward toward the installed position, the rearward projecting finger 132 to be fitted into the gutter hem 18. Depending on the specific profile of the gutter (which can vary depending on the configuration of the gutter forming equipment), this can occur in several different ways, one of which is depicted in FIGS. 8-10 and another of which is depicted in FIGS. 20-22. In the FIGS. 8-10 example, the hem 18 of the gutter 10 is received in the gap 133 when the dual-purpose gutter guard 102 is in the upright orientation (FIG. 8) and the rearward projecting finger 132 rotates into full engagement with the hem has the dual purpose gutter guard 102 rotates downward (FIGS. 9-10). In the FIGS. 20-22 example, the hem 18 is not fitted into the gap 133 initially (FIG. 20). In this example, rearward projecting finger 132 is fitted into the hem 18 as the dual-purpose gutter guard 102 rotates downward. The downturned edge margin 210 engages (cams against) the curved surface of the front gutter wall 14. This (camming) engagement forces the rearward projecting finger 132 upward, pressing it into the hem 18 as the dual-purpose gutter guard 102 rotates down. The interaction between the downturned edge margin 210 and the curved surface of the front gutter wall 14 as the dual-purpose gutter guard 102 is rotated downward causes the rearward projecting finger 132 to be fitted into the gutter hem 18 when the dual-purpose gutter guard 102 reaches the installed position depicted in FIG. 10.

As shown in FIGS. 10 and 22, the dual-purpose gutter guard 102 reaches the installed position when the rear connection structure 110 clips onto the rear gutter wall 22. In the installed position, the downturned edge margin 210 of the front connection structure 106 engages the front gutter wall 14. Suitably, the front gutter wall 14 imparts reward pressure on the downturned edge margin 210, whereby the front gutter wall urges the rearward projecting finger 132 into secure engagement with the hem 18 in the installed position. The height of the downturned edge margin 210 is configured so that the tip of the downturned edge margin 210 will engage the bottom portion of the gutter lip 16 before the rearward projecting finger 132 will disengage from the gutter hem 18. Thus, the downturned edge margin 210 is sized and arranged to engage with the gutter 10 so as to keep the rearward projecting finger 132 seated in the hem 18, thereby firmly connecting the front connection structure 106 to the gutter lip 16 so that the gutter 10 can be securely and safely hung from the dual-purpose gutter guard 102.

The overlay panel 104 may be optionally installed on one or more of the dual-purpose gutter guards 102 before or after assembling the dual-purpose gutter guards on the gutter 10. The overlay panel 104 is suitable for use when a finer degree of debris filtration is desired than the degree of debris filtration provided by the first openings in the dual-purpose gutter guard 102. In one example, the overlay panel 104 is installed on a dual-purpose gutter guard 102 by fitting the rear end portion 116 of the overlay panel within the overlay receiving channel 112 of the dual-purpose gutter guard, and securing the front end portion 114 of the overlay panel to the primary covering section 126 of the dual-purpose gutter guard by the installing screws 120. The front end portion 114 of the overlay panel 104 could connect to the guard in other ways (e.g., friction, clip, interference fit, mating, etc.) without departing from the scope of the present disclosure. Moreover, the front end portion 114 of the overlay panel 104 may be installed to rest on the primary covering section 126 without securement.

Next, each of the dual-purpose gutter guards 102 are secured in series to form a reinforced gutter unit by preinstalling the plurality of screws 121 into a screw section 140 of the rear connection structure 110 of each of the dual-purpose gutter guards. In an example embodiment, the screws 121 are installed so that tip portions of the screws engage the top edge margin 24 of the rear gutter wall 22 as set screws and thereby temporarily affix the dual-purpose gutter guards 102 to the gutter 10. However, this is not strictly necessary. The screws 121 may be advanced to a lesser degree, which still preinstalls the screws so that they are easier for the installer to drive into the fascia board after the gutter 10 and covering system 100 are lifted into position.

Advantageously, the previous steps of the method including installing and securing the dual-purpose gutter guards 102 and overlay panel 104 to the gutter 10, are performed while the gutter 10 rests on ground or another surface below the fascia board, thereby minimizing installation tasks performed on a ladder at the height of the fascia board on the roof. Accordingly, all of the screws 120, 121 in the installation process may be preinstalled on the ground. Alternatively, some of the screws 120 and/or screws 121 used in the installation are preinstalled on the ground and others are installed after the gutter is hung from the fascia board by the preinstalled screws. From here, the reinforced gutter unit is lifted into a guttering position on the fascia board, and the pre-installed screws are advanced further into the screw section 140 of the rear connection structure 110 of each of the dual-purpose gutter guards 102 into the fascia board to hang the reinforced gutter unit.

Figure 11:
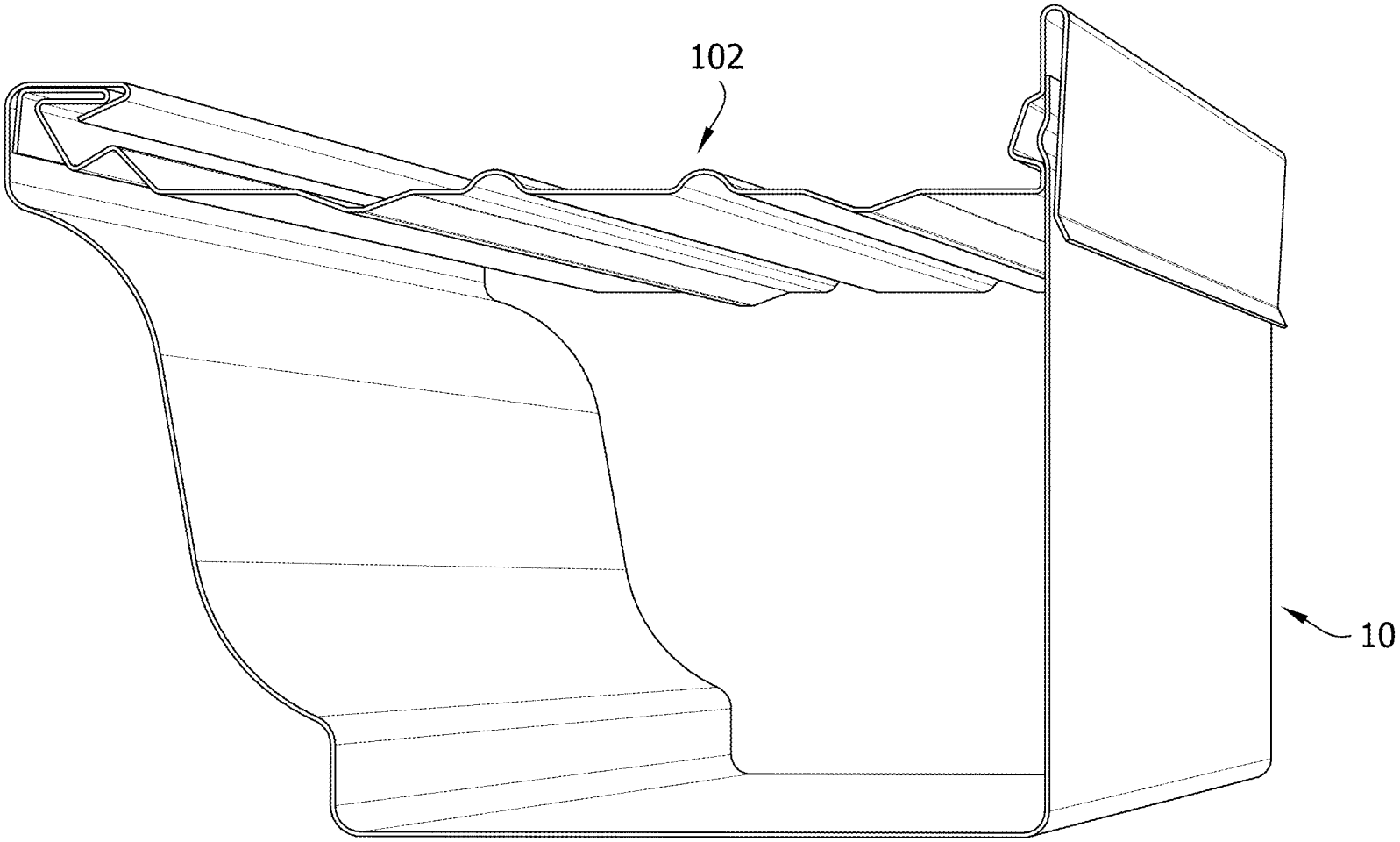
FIG. 11 is a perspective of a dual-purpose gutter guard installed on a six-inch gutter.
Figure 12:
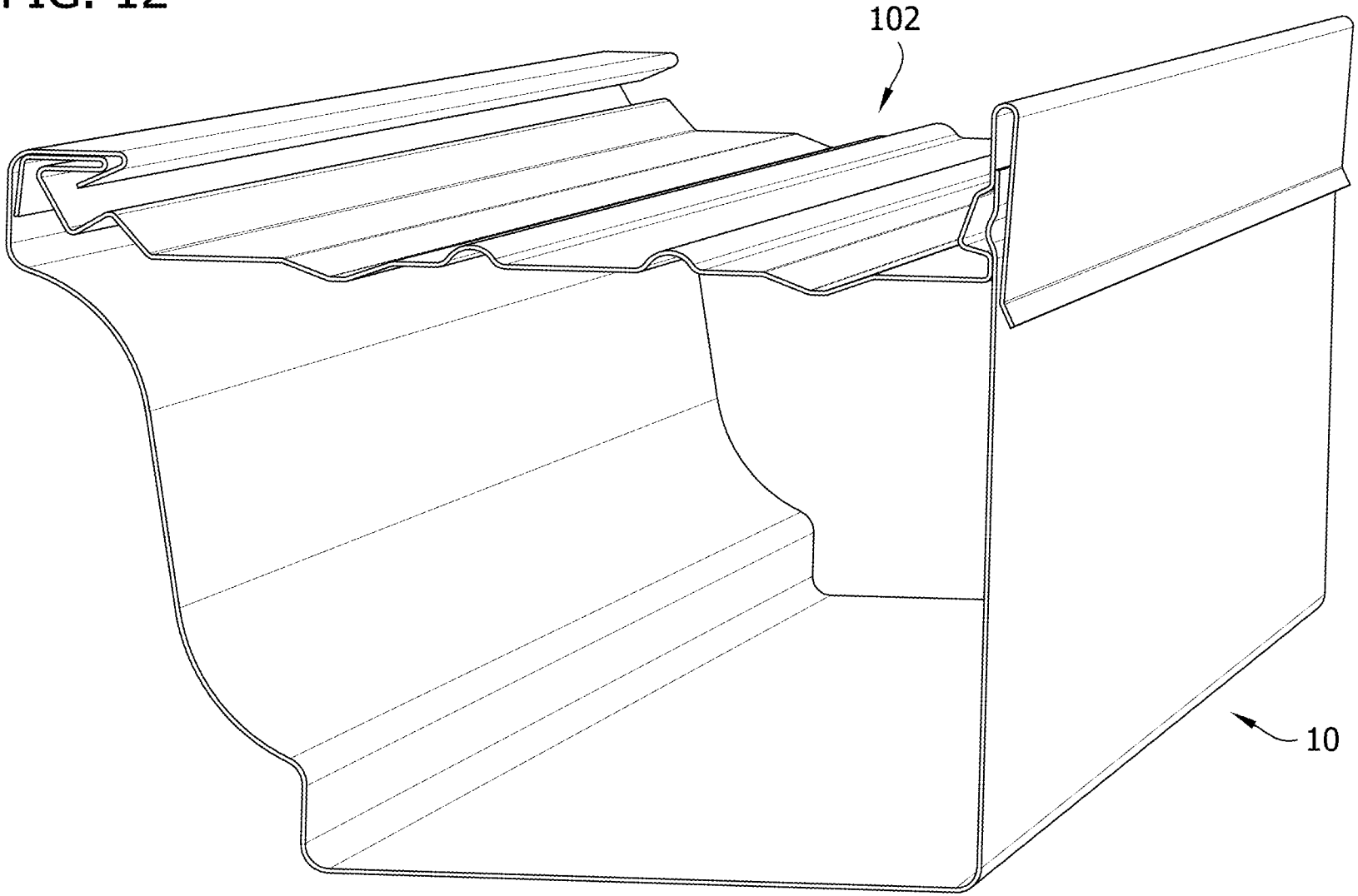
FIG. 12 is another perspective similar to FIG. 11.
Figure 13:
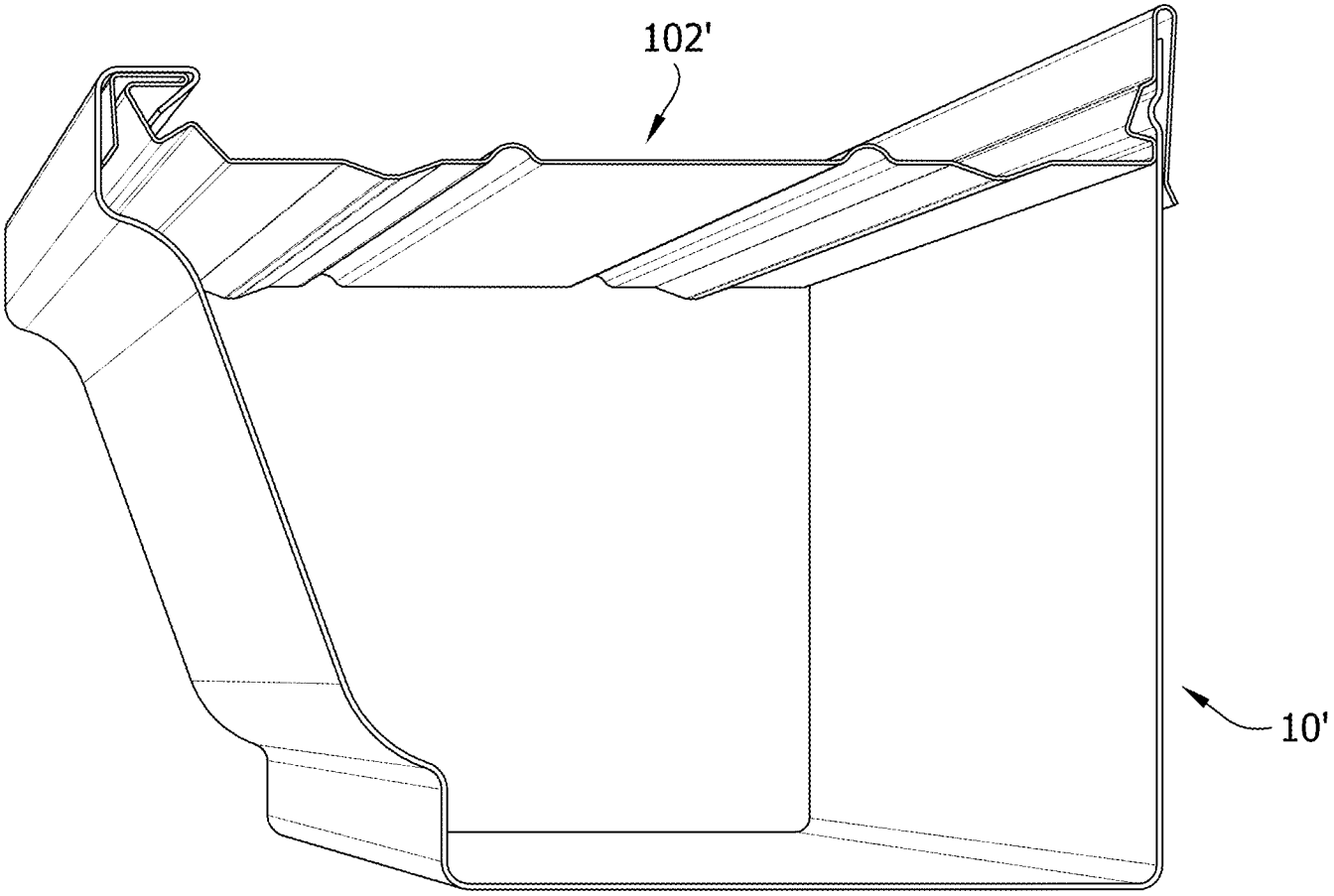
FIG. 13 is a perspective of another dual-purpose gutter guard installed on a five-inch gutter.
Figure 14:
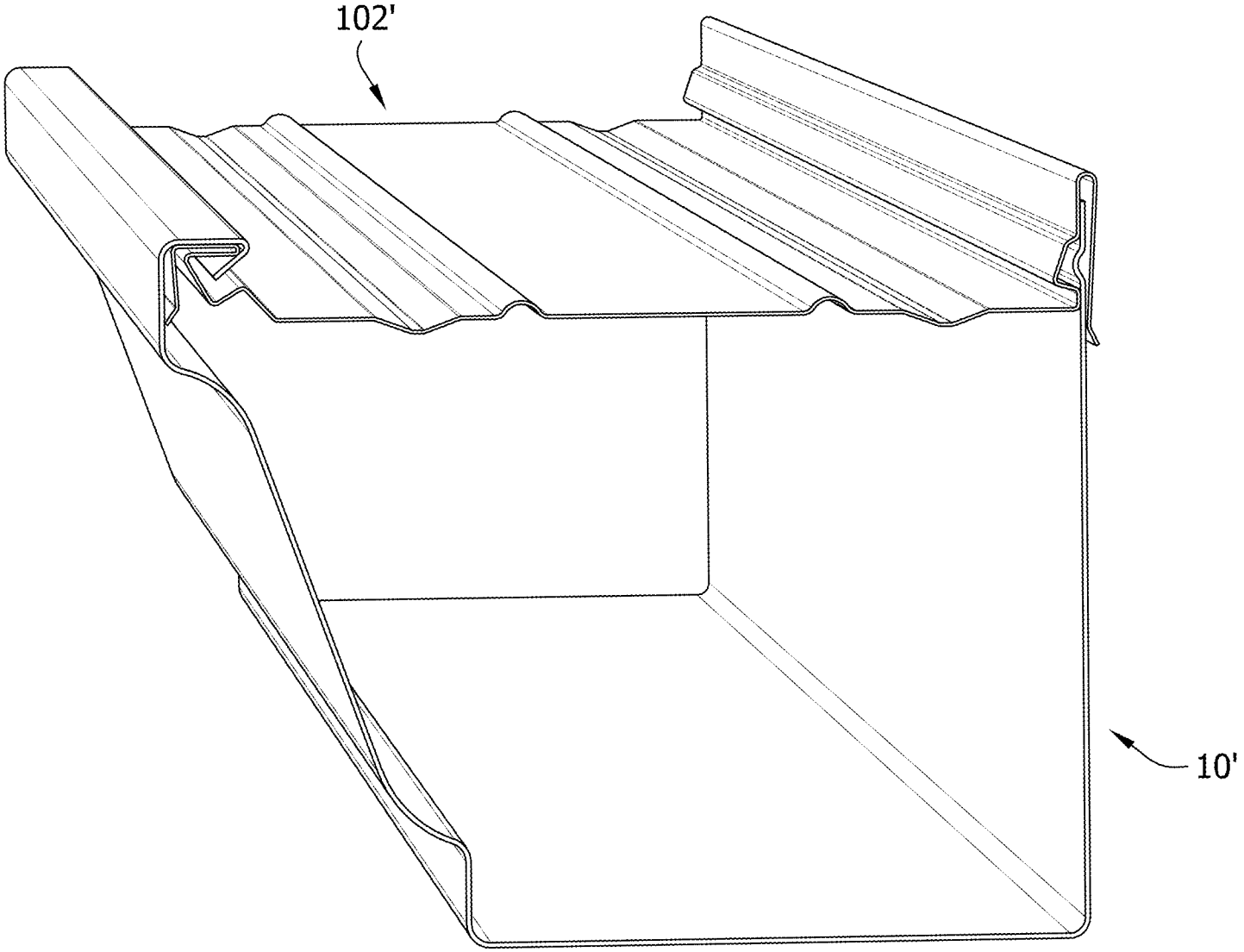
FIG. 14 is another perspective similar to FIG. 13.

It will be understood that dual-purpose gutter guards in accordance with the present disclosure can be adapted for use with gutters of different sizes. For example, FIGS. 11 and 12 depict one dual-purpose gutter guard 102 in accordance with the present disclosure that is configured for use with a five-inch gutter 10, and FIGS. 13 and 14 depict another dual-purpose gutter guard 102' that is configured for use with a six-inch gutter 10'. The dual-purpose gutter guards and accessories described herein can also be configured for use with half-round gutters in some embodiments.

It is noted that the dual-purpose gutter guard 102' for use with a five-inch gutter 10' has the same rear connection structure as the dual-purpose gutter guard 102 for use with a six-inch gutter 10. Those skilled in the art will recognize, however, that the rear gutter wall of a six-inch gutter 10 is taller than the rear gutter wall of a five-inch gutter 10'. To ensure the same rear connection structure profile seats at the appropriate height on the rear gutter wall of the five-inch gutter 10', the inventors contemplate performing an additional metalworking operation on the rear connection structure of dual-purpose gutter guard 102' to form a stop for seating the top edge of the rear gutter wall of the five-inch gutter. For example, in one embodiment, the top portion of the rear connection structure is subjected to a metal working process colloquially known as "stitching" whereby depressions or tangs are punched in the top portion of the rear connection structure at spaced apart locations along the length at the desired heightwise position for the stop.

Figure 15:
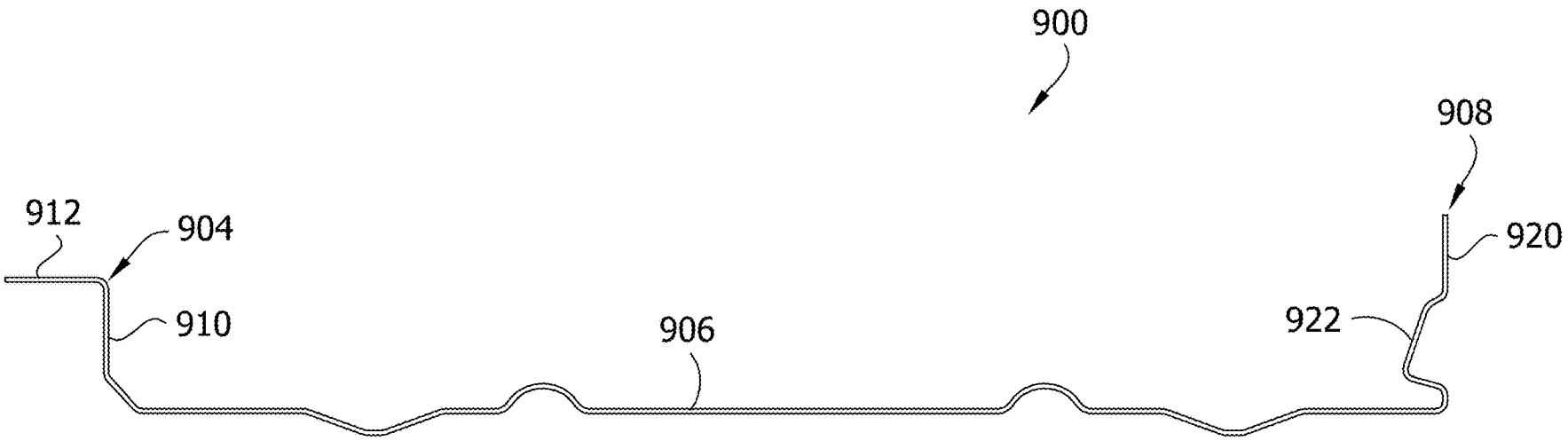
FIG. 15 is an end view of a non-hanger covering panel of a gutter hanger and covering system for a six-inch gutter.
Figure 16:
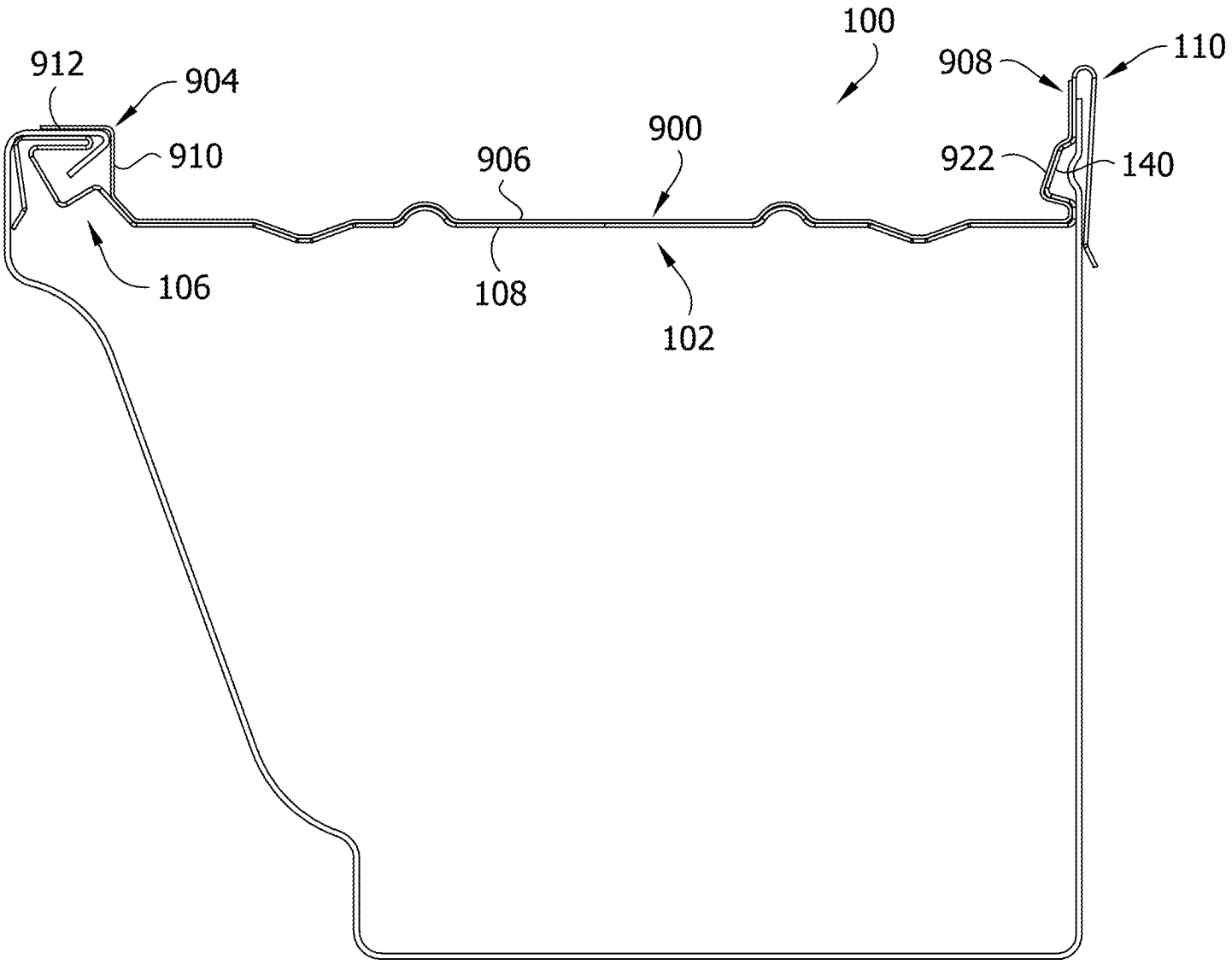
FIG. 16 is an end view of a gutter with a dual-purpose gutter guard and the non-hanger covering panel of FIG. 15 installed.

Referring now to FIGS. 15 and 16, in one or more embodiments, the gutter hanger and covering system 100 further comprises a non-hanger covering panel 900. As will be explained in detail below, one or more non-hanger covering panels 900 can be installed in a run with one or more dual-purpose gutter guards 102 such that the non-hanger covering panel(s) and dual-purpose gutter guard(s) 102 cover different portions of a gutter 10. As will be further explained below, the non-hanger covering panels 900 have several potential uses in the gutter hanger and covering system 100. First, they can be used to cover inside and outside corners of guttering that is hung and otherwise protected by dual-purpose gutter guards 102. Second, they can be used as removable access panels to allow for gutter inspection and cleanout after installation anytime during the life of the guttering.

As shown in FIG. 15, the non-hanger covering panel 900 comprises a front portion 904, a central portion 906, and a rear portion 908. There is some similarity between the profile of the non-hanger covering panel 900 and the profile of the dual-purpose gutter guard 102, but the non-hanger covering panel is discernibly shaped differently in profile than the dual-purpose gutter guard. In general, the non-hanger covering panel 900 is configured to be installed on the gutter 10 adjacent a dual-purpose gutter guard 102 such that the front portion 904 is located adjacent the gutter lip 16, the rear portion 908 is located adjacent the rear gutter wall 22, and the central portion 906 covers a portion of the open top 12 of the gutter 10 that is not covered by the dual-purpose gutter guard. The central portion 906 of the non-hanger covering panel 900 suitably defines openings for water passage and debris filtration. In certain embodiments, the non-hanger covering panel 900 is formed from the same material and has the same type of filtration openings as the dual-purpose gutter guard 102, though this is not strictly necessary.

The front portion 904 of the non-hanger covering panel 900 has a different profile than the front connection structure 106 of the dual-purpose gutter guard 102. This is because the non-hanger covering panel 900 is not intended to function as a gutter hanger or to support any of the weight of the gutter 10 (in contrast, of course, to the dual-purpose gutter guard 102). Hence, whereas the front connection structure 106 of the dual-purpose gutter guard 102 is configured to clip into the gutter lip 16 of the gutter 10 from below, the front portion 904 of the non-hanger covering panel 900 is configured to lie on top of the gutter lip 16, as shown in FIG. 16. In one or more embodiments, the front portion 904 of the non-hanger covering panel 900 comprises an up leg 910 extending upward from the central portion 906 and a terminal horizontal flange 912 extending forward from the up leg. (Here, "terminal" means that the material forming the covering panel 900 ends at the terminal edge of the flange 912). The terminal horizontal flange 912 is configured to lie on top of the gutter lip 16. More generally, the front portion 904 of the non-hanger covering panel 900 is configured to releasably engage the gutter lip 16 such that the front portion of the non-hanger covering panel is selectively disconnectable from the gutter lip 16 while the front connection structure 106 of an adjacent dual-purpose gutter guard 102 remains connected to the gutter lip. An installer may optionally releasably secure the non-hanger covering panel 900 to the gutter lip 16 by installing one or more screws (not shown) through the terminal horizontal flange 912. These screws may be removed whenever there is need of removing the covering panel 900 to access the inside of the gutter 10, e.g., for inspection or cleanout.

The rear portion 908 of the non-hanger covering panel 900 has a different profile than the rear connection structure 110 of the dual-purpose gutter guard 102. Whereas the rear connection structure 110 of the dual-purpose gutter guard 102 comprises a clip configured to clip onto the rear gutter wall 22 of the gutter 10, the rear portion 908 of the non-hanger covering panel 900 comprises a terminal upturned flange 920 configured for non-clipped, face-to-face engagement with the rear gutter wall. (Again, "terminal" here means that the material forming the covering panel 900 ends at the edge of the upturned flange 920). Thus, the rear portion 908 is configured to releasably engage the rear gutter wall 22 of the gutter 10 such that it is selectively disconnectable from the rear gutter wall and the fascia board while the rear connection structure 110 of the dual-purpose gutter guard 102 remains connected to the rear gutter wall 22 and the fascia board. Suitably, the terminal upturned flange 920 comprises a protruding screw section 922 configured to engage the protruding screw section 140 of the rear connection structure 110 in nested relation therewith. An installer may optionally releasably secure the non-hanger covering panel 900 to a fascia board by installing one or more screws through the screw section 922. These screws may be removed whenever there is need of removing the covering panel 900 to access the inside of the gutter 10, e.g., for inspection or cleanout.

Figure 17:
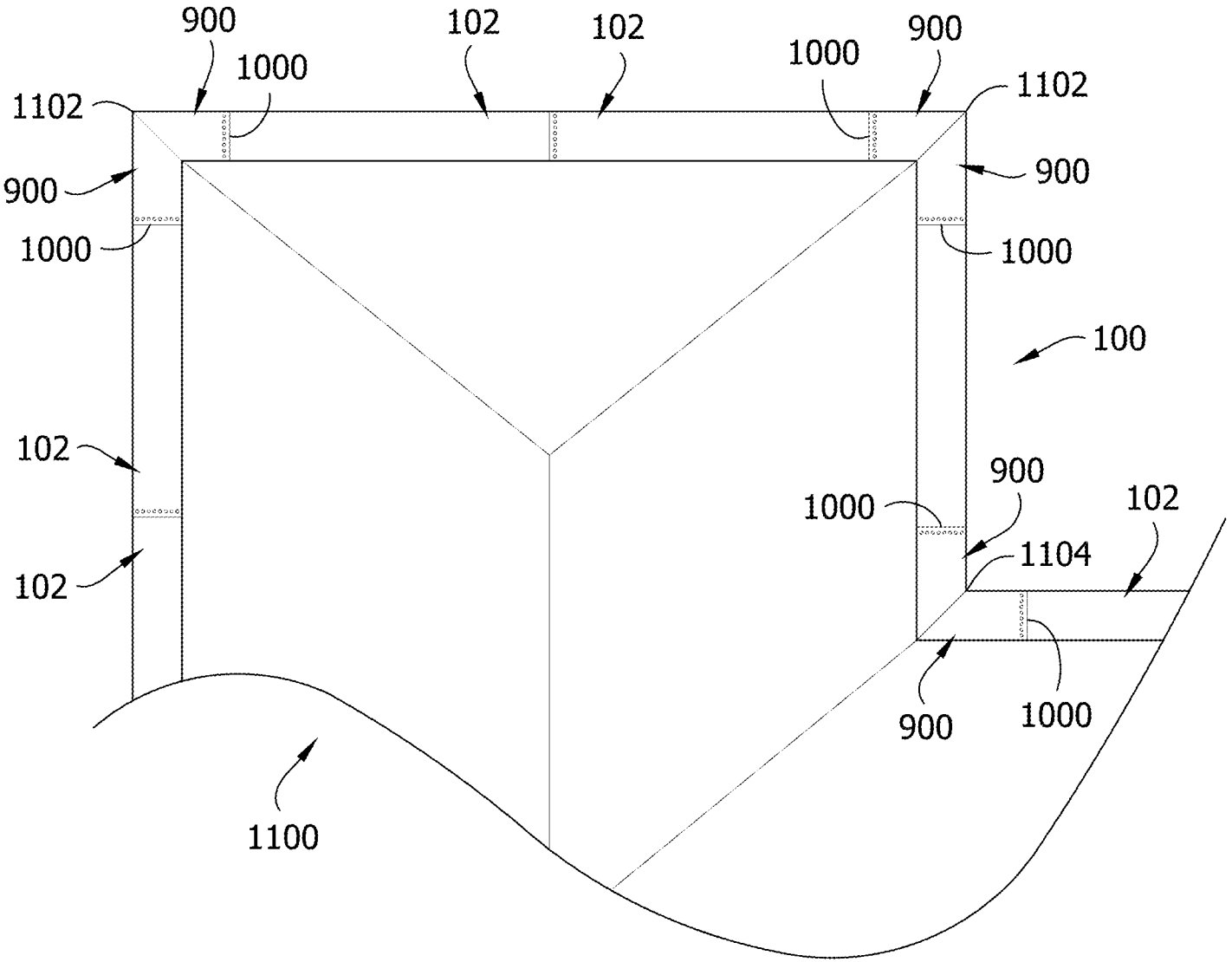
FIG. 17 is a schematic plan view of a building with the gutter hanger and covering system installed.

In the illustrated embodiment, the central portion 906 of the non-hanger covering panel 900 and the central portion 108 of the dual-purpose gutter guard 102 have corresponding undulating profiles. Referring to FIG. 17, each non-hanger covering panel 900 is configured to be installed so that it overlaps an adjacent dual-purpose gutter guard 102 at an overlap 1000. FIG. 16 shows how the non-hanger covering panel 900 fits over the dual-purpose gutter guard 102 at the overlap. As shown, the central portion 906 of the non-hanger covering panel 900 conformingly engages the central portion 108 of the dual-purpose gutter guard 102, the terminal upturned flange 920 is positioned in front of the rear connection structure 110 in face-to-face contact therewith, and the front portion 904 and front connection structure 106 engage opposite sides of the gutter lip 16.

FIG. 17 schematically illustrates a building 1100 having gutters 10 that are hung and covered by system 100 made up of the dual-purpose gutter guards 102 and the non-hanger covering panels 900. It can be seen that the dual-purpose gutter guards 102 cover a first portion of the guttering 10 and the non-hanger covering panels 900 cover a second portion of the guttering that is not covered by the dual-purpose gutter guards. There are small overlaps 1000 where the dual-purpose gutter guards 102 and non-hanger covering panels 900 come together. Although not shown, it is to be understood that one or more overlay panels 104 may be installed on the dual-purpose gutter guards 102 and/or non-hanger covering panels 900 at any desired location along the guttering for finer debris filtration. Fine debris overlay panels can also be installed over the non-hanger panels.

As shown in FIG. 17, in an example embodiment, the non-hanger covering panels 900 are installed on the guttering at one or more corners 1102, 1104 of the building 1100. Suitably, the non-hanger covering panels 900 are pre-manufactured in rectangular lengths such that the ends of each non-hanger covering panel extend perpendicular to the length as pre-manufactured. Thus, the non-hanger covering panels 900 are configured to be field-cut at desired miter angles before being installed on the guttering at the corners 1102, 1104. It can be seen that the non-hanger covering panels 900 are capable of being field-cut for covering outside corners 1102 or inside corners 1104 of the guttering 10. The inventors have recognized that it is undesirable to field-cut the dual-purpose gutter guards 102 on miter angles because doing so may deform the front connection structure 106 or rear connection structure 110 such that either connection structure may not properly engage the gutter 10. Accordingly, one benefit of the non-hanger covering panels 900 is that they provide a visually appealing way to cover and protect the corners of guttering that is hung and predominantly covered by the dual-purpose gutter guards 102.

Another benefit of the non-hanger covering panels 900 is that, because they are removable, they provide a way of accessing the inside of guttering that is hung on the building 1100 via the dual-purpose gutters 102 without taking the guttering down from the building 1100. Accordingly, it will be understood that the covering panels 900 can be installed anywhere along the guttering that is useful for inspection or cleanout access, including non-corner locations (not shown in FIG. 17).

Example methods of using the gutter hanging and covering system 100, including dual-purpose gutter guards 102 and non-hanger covering panels 900, will now be described. The system 100 is initially put to use when new gutters 10 are to be installed on a building 1100. Using the techniques described above, an installer installs dual-purpose gutter guards 102 on gutters 10 from the ground and then hangs the gutters from fascia boards of the building 1100 by using screws 121 to fasten the rear connection structures 110 to the fascia boards. At this point the dual-purpose gutter guards support the weight of the gutters 10.

Once all of the guttering has been hung on the building 1100, the dual-purpose gutter guards 102 are arranged so that certain portions of the guttering (e.g., corners or access ports) remain uncovered. For each of these uncovered portions, the installer can, if desired, cut one or more non-hanger covering panels 900 to the appropriate size and shape. Once properly sized non-hanger covering panels 900 are obtained, the installer installs the non-hanger covering panels on the guttering. For corner regions 1102, 1104, the installer can cut two non-hanger covering panels 900 at the appropriate miter angles and install them to form a miter joint. Each non-hanger covering panel 900 is installed so that the central portion 906 conformingly overlaps the central portion 108 of an adjacent dual-purpose gutter guard 102 at an overlap 1000. The installer places each non-hanger covering panel 900 on the guttering so that the front portion 904 lies on top of the gutter lip 16 and so that the rear portion 908 engages the rear gutter wall 22 in non-clipped, face-to-face engagement therewith. In certain embodiments, the installer uses screws to removably fasten the front portion 904 to the gutter lip 16 and to removably fasten the rear portion 908 to the fascia board.

At any time during the life of the guttering, the non-hanger covering panels 900 allow for inspecting the inside of the gutter 10. A suitable method of inspecting guttering in accordance with the present disclosure comprises removing a non-hanger covering panel 900 to expose a portion of the guttering while the guttering remains supported on the building 1100 by the dual-purpose gutter guards 102. Subsequently, the inspector inspects the guttering through the exposed portion of the gutter 10. For example, an inspector may place a camera or hose into the gutter 10 through the exposed portion and conduct the desired inspection. When the inspection is complete, the removed covering panel 900 is reinstalled.

At any time during the life of the guttering, the non-hanger covering panels 900 also facilitate cleaning the inside of the gutter 10. A suitable method of cleaning guttering in accordance with the present disclosure comprises removing a non-hanger covering panel 900 to expose a portion of the guttering while the guttering remains supported on the building 1100 by the dual-purpose gutter guards 102. Subsequently, the cleaner cleans the guttering through the exposed portion of the gutter 10. For example, a cleaner may place a vacuum hose, robot cleaner, cleaning brush, and/or water hose into the gutter 10 through the exposed portion to clean the guttering. When cleaning is complete, the removed covering panel 900 is reinstalled.

Figure 18:
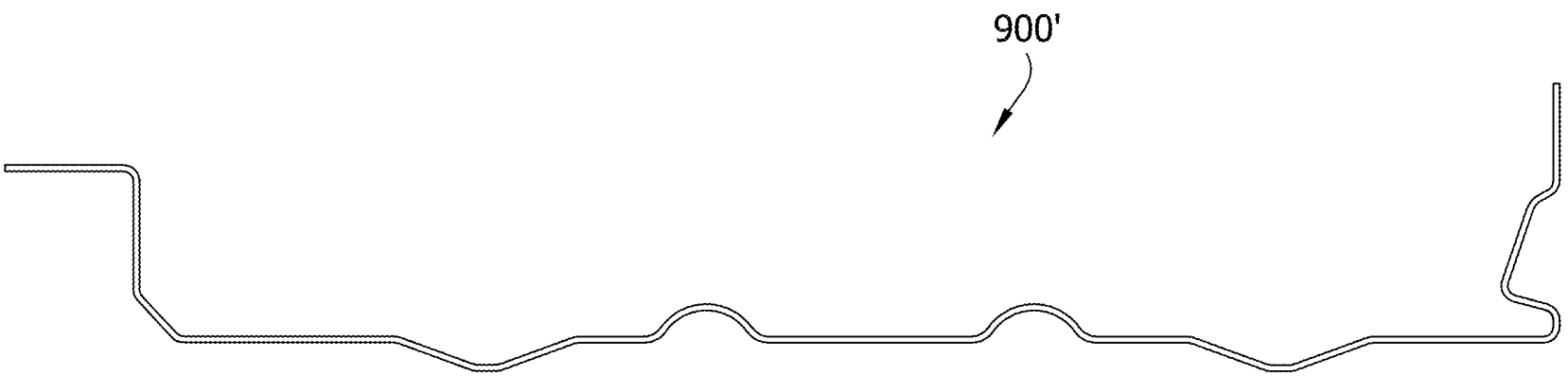
FIG. 18 is an end view of a non-hanger covering panel of a gutter hanger and covering system for a five-inch gutter.
Figure 19:
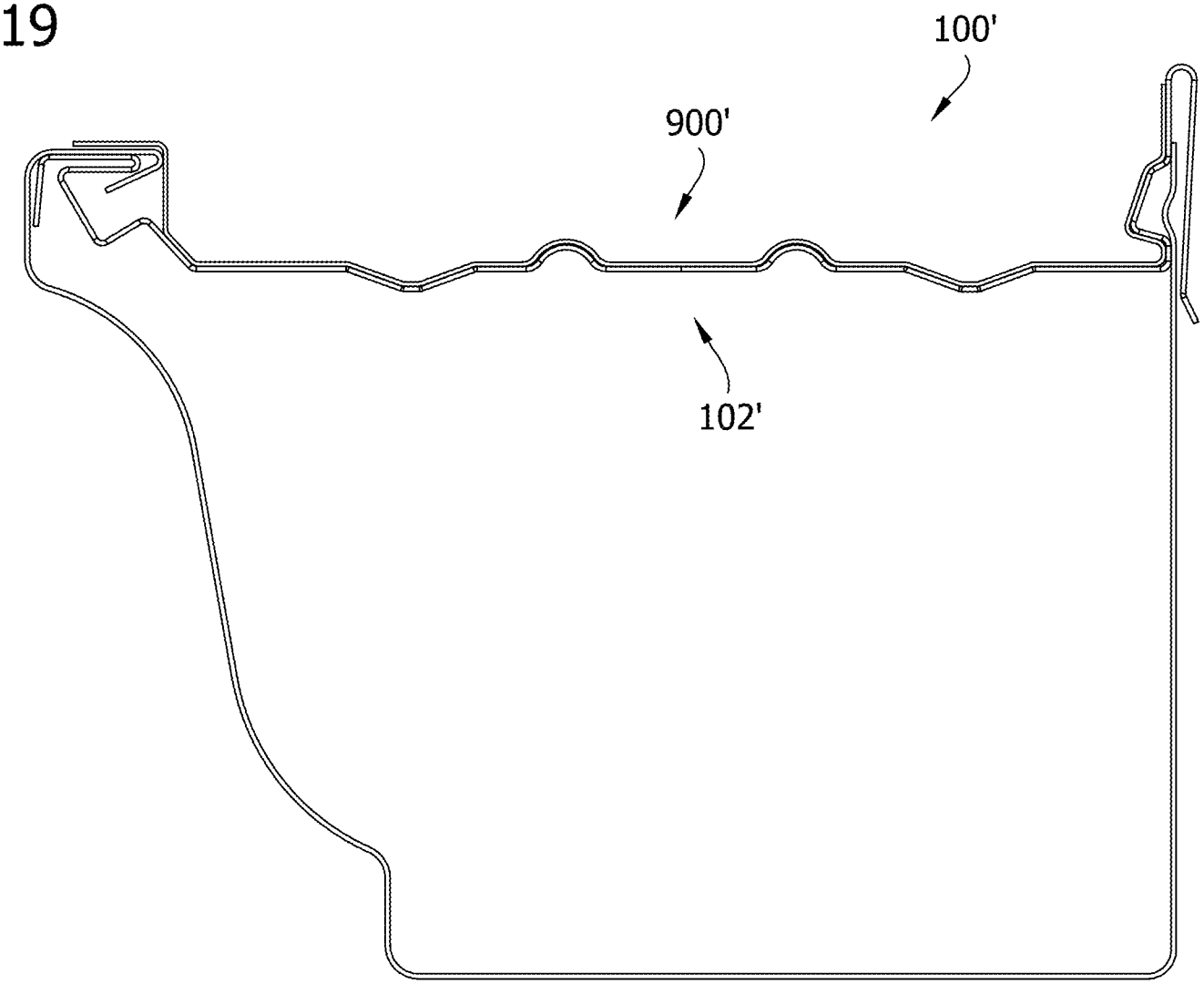
FIG. 19 is an end view of a five-inch gutter with a dual-purpose gutter guard and the non-hanger covering panel of FIG. 18 installed.

Referring to FIGS. 18 and 19, the non-hanger covering panel 900' for a gutter hanging and covering system 100' for a five-inch gutter 10' is shown as another example.

It will be understood that the principles of the various components of the gutter hanging and covering system disclosed herein can be adapted for use with any size gutter.

Having described the disclosure in detail, it will be apparent that modifications and variations are possible without departing from the scope of the disclosure defined in the appended claims.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description and shown in the accompanying drawings shall be interpreted as illustrative and not in a limiting sense.

The invention claimed is:

1. A dual-purpose gutter guard for covering a gutter and hanging the gutter from a fascia board, wherein the gutter has a gutter lip, a hem, a front gutter wall, a bottom gutter wall, and a rear gutter wall, the dual-purpose gutter guard comprising:

a rear connection structure configured to couple to the rear gutter wall;

a front connection structure configured to engage an underside of the gutter lip and tuck into the hem to couple the dual-purpose gutter guard to the gutter lip; and a central portion configured to cover an open top of the gutter, the central portion comprising a primary covering section for covering at least a portion of the open top of the gutter and an angled debris lifter extending forward and upward from the primary covering section toward the front connection structure;

wherein the front connection structure comprises a rearward projecting finger configured to engage the hem of the gutter lip;

wherein the angled debris lifter comprises an apex and wherein the rearward projecting finger comprises a tip spaced apart from the apex by an open gap.

2. The dual-purpose gutter guard of claim 1, wherein the gap has a dimension extending from the tip to the apex, and the dimension is less than ⅜".

3. The dual-purpose gutter guard of claim 1, wherein the dual-purpose gutter guard is configured to be installed on the gutter by orienting the dual-purpose gutter guard in an upright orientation with respect to the gutter and rotating the dual-purpose gutter guard downward to an installed position whereby the rearward projecting finger engages the hem of the gutter lip and the rear connection structure clips onto the top edge margin of the rear gutter wall.

4. The dual-purpose gutter guard of claim 3, wherein as the dual-purpose gutter guard rotates downward to the installed position, a downturned edge margin of the front connection structure is configured to cam against a curved surface of the front gutter wall to press the rearward projecting finger upward into the hem of the gutter lip.

5. The dual-purpose gutter guard of claim 1, further comprising a bend between the primary covering section and the angled debris lifter.

6. The dual-purpose gutter guard of claim 5, wherein the angled debris lifter has an angled debris lifter height from the bend to the apex and wherein the angled debris lifter height is greater than ¼".

7. The dual-purpose gutter guard of claim 6, wherein the tip of the rearward projecting finger is vertically spaced apart from the bend by a finger height and wherein the finger height and the angled debris lifter height differ by less than ⅜".

8. The dual-purpose gutter guard of claim 5, wherein the primary covering section includes a front covering segment adjacent the bend and wherein an included angle between the angled debris lifter and the front covering segment above the dual-purpose gutter guard is in an inclusive range from 120° to 160°.

9. The dual-purpose gutter guard of claim 1, wherein the front connection structure comprises a decline segment extending forward and downward from the apex to a lower bend, an incline segment extending forward and upward from the lower bend to a rearward bend, a lower finger segment extending rearward from the rearward bend to a finger crease, and an upper finger segment extending forward from the finger crease.

10. The dual-purpose gutter guard of claim 9, wherein the apex defines an included angle below the dual-purpose gutter guard in an inclusive range from 80° to 150°.

11. The dual-purpose gutter guard of claim 9, wherein the lower bend defines an included angle above the dual-purpose gutter guard in an inclusive range from 80° to 150°.

12. The dual-purpose gutter guard of claim 9, wherein the rearward bend defines an included angle rearward of the incline segment and below the lower finger segment in an inclusive range from 20° to 60°.

13. The dual-purpose gutter guard of claim 9, wherein the lower finger segment has a front to back dimension extending from the rearward bend to the finger crease in an inclusive range from ¼" to ¾".

14. The dual-purpose gutter guard of claim 9, wherein the front connection structure further comprises a downturned edge margin and a downturned bend between the downturned edge margin and the upper finger segment.

15. The dual-purpose gutter guard of claim 1, wherein the dual-purpose gutter guard has a length and wherein the dual-purpose gutter guard is configured to hang the same length of gutter from a fascia board without any other gutter hanger or reinforcement.

16. The dual-purpose gutter guard of claim 1, wherein the front connection structure is configured to couple to the gutter lip for hanging the gutter from a fascia board without any separate fasteners.

* * * * *